US006494013B2

(12) United States Patent
Winskye

(10) Patent No.: US 6,494,013 B2
(45) Date of Patent: Dec. 17, 2002

(54) BUILDING CONSTRUCTION SYSTEM, COMPONENTS THEREOF, AND METHOD THEREFORE

(76) Inventor: Richard W. Winskye, P.O. Box 64015, Tucson, AZ (US) 85728-4015

( * ) Notice: Subject to any disclaimer, the term of this patent is extended or adjusted under 35 U.S.C. 154(b) by 138 days.

(21) Appl. No.: 09/765,913

(22) Filed: Jan. 20, 2001

(65) Prior Publication Data

US 2002/0095888 A1 Jul. 25, 2002

(51) Int. Cl.[7] ..... E04B 1/00

(52) U.S. Cl. ..... 52/745.01; 52/270; 52/284; 52/653.2; 52/220.2; 52/589.1; 52/592.1

(58) Field of Search ..... 52/745.13, 745.1, 52/747.1, 653.1, 653.2, 656.1, 284, 285.1, 270, 745.01, 589.1, 592.1, 578, 220.1, 220.2, 220.7

(56) References Cited

U.S. PATENT DOCUMENTS

| | | | | |
|---|---|---|---|---|
| 108,068 | A | | 10/1870 | Utley |
| 1,386,554 | A | | 8/1921 | Dalglish |
| 2,176,776 | A | | 10/1939 | Terrell |
| 3,080,674 | A | | 3/1963 | Amici |
| 3,203,145 | A | | 8/1965 | Raynes |
| 3,290,848 | A | | 12/1966 | Moss |
| 3,774,362 | A | * | 11/1973 | Matuschek et al. ..... 52/206 |
| 4,328,651 | A | | 5/1982 | Gutierrez |
| 4,416,097 | A | | 11/1983 | Weir |
| 4,774,794 | A | | 10/1988 | Grieb |
| 5,329,741 | A | | 7/1994 | Nicolaidis et al. |
| 5,375,381 | A | * | 12/1994 | Park et al. ..... 52/92.1 |
| 5,377,470 | A | | 1/1995 | Hebinck |
| 5,417,026 | A | | 5/1995 | Brumfield |
| 5,799,462 | A | | 9/1998 | McKinney |
| 5,826,389 | A | * | 10/1998 | Siler ..... 52/309.1 |
| 6,006,480 | A | * | 12/1999 | Rook ..... 52/309.12 |
| 6,085,477 | A | * | 7/2000 | Hiese et al. ..... 52/270 |

* cited by examiner

*Primary Examiner*—Carl D. Friedman
*Assistant Examiner*—Jennifer I. Thissell
(74) *Attorney, Agent, or Firm*—The Halvorson Law Firm

(57) ABSTRACT

The present invention relates generally to a building construction system, the components thereof, and method therefore. More specifically, the present invention relates to a building construction system that utilizes specifically designed component parts that fit together, such as by male/female connections, and are permanently attached through the use of an adhesive, or bonding glue, to create an extra strong and uniformly tight structure. If effect, the end result is equivalent to a one-piece construction since all components are permanently "chemically welded" to each other with all components being made from the same type of materials.

19 Claims, 30 Drawing Sheets

BUILDING CONSTRUCTION SYSTEM, COMPONENTS THEREOF, AND METHOD THEREFORE

FIELD OF THE INVENTION

The present invention relates generally to a building construction system, the components thereof, and method therefore. More specifically, the present invention relates to a building construction system that utilizes specifically designed component parts that fit together, such as by male/female connections, and are permanently attached through the use of an adhesive, or bonding glue, to create an extra strong and uniformly tight structure. In effect, the end result is equivalent to a one-piece construction since all components are permanently "chemically welded" to each other with all components being made from the same type of materials.

BACKGROUND

Construction of private dwellings, both in the United States and abroad, has been substantially limited by the relatively low availability of skilled labor and high strength building materials. Furthermore, the construction of dwellings is often influenced by frequently encountered high/low heats and humidities at the construction sites, combined with the resultant biological attacks on the structure from mildew, insects and organisms which thrive in hot and/or humid environments. In third world countries, one solution that has existed for ages in such locations is to make the housing out of relatively flimsy, locally available materials, such as palm fronds or straw and the like, combined with mud and clay infused into a bare structure. However, such structures, while certainly economical, provide little in the way of genuine protection from the elements and provide extensive cover for insects and vermin. Thus, it is very difficult to prevent the spread of disease in and among such dwellings, and the quality of daily life in such structures is necessarily low. Furthermore, such construction is not amenable to housing modem equipment or perishables, offers little shelter from the elements and thus severely limits their use for business purposes.

Important in the consideration in building construction, especially in the United States, are the high cost of construction because of the large amount of skilled labor required in the construction process. Therefore, it would be useful to provide a construction design that would not use expensive materials and does not require large amounts of skilled labor, and is easily erected at the site where the housing is desired.

Normal construction of buildings requires the use of many different and varied construction labor techniques and skills. Often it requires carpenters, for wood construction, masons, for cement and brick construction, roofers, drywall installers, and others. Furthermore, normal conventional construction requires the use of many and varied materials, such as plywood, wood rafters, drywall, bricks or concrete blocks, roofing materials, to name a few. These materials are typically connected together using a variety of connectors, such as nails, screws, staples, pegs and the like. While the resulting building provides shelter or housing, it is expensive due to the various materials and various different skills required to complete the construction. In addition, it takes a considerable amount of time to complete the construction due to the coordination required between the various labor skills and material application processes. In summary, the resulting cost for constructing any structure is high and the length of time until completion is long.

Furthermore, the strength of different buildings will vary substantially based on the quality of the materials used and the skills of the individual work specialists performing their specific duties. Currently, there is no uniformity in the building strength as compared to other buildings. Therefore, it is useful to provide a building system that requires only one type of material and can use the same labor force for all facets of construction.

Moreover, existing building construction systems also result in wide variances as far energy efficiency is concerned. One building may be very cost effective as far as the costs of heating and air conditioning are concerned where another of the same size, by comparison, may be very expensive for such costs. It would be useful for a construction system to provide uniform and equal energy costs that will also be very low.

An object of the present invention is to alleviate the above described disadvantages of the prior art, by alleviating the problems of uneven and high energy costs, time delays in the construction process, lack of uniformity in the final building's physical strength, and the high financial cost of construction. In addition, since all components of the present invention are "pre-made" to fit the individual building pattern, then waste and unnecessary material are at an absolute minimum as compared to considerable wasted materials in all current building construction systems.

SUMMARY OF THE INVENTION

It is an object of the present invention to provide a unique construction system that uses unique building materials that are specifically designed for this process so that the resulting construction is simpler and more economical than conventional and other construction systems that are currently being used for "on-site" construction of residential and all other building construction projects. This system is primarily orientated to one or two levels in height.

It is another object of the present invention to have this new system available for use, with some modifications, for the construction of pemanent and mobile home construction.

It is a further object of the present invention to improve the physical strength and safety of the final construction project substantially over the physical strength of buildings that are built using currently acceptable methods.

It is yet another object of the present invention to provide a construction process that is so simple that almost anyone can construct a safe and usable building even if they are not highly educated or trained in the fields of construction. Thus allowing a substantial increase in labor resources that can be used to build the buildings according to the present system.

It is yet a further object of the present invention to provide a construction process that uses unique materials, which can be mass-produced on a very economical basis.

It is yet a further object of the present invention to provide a building process that is flexible enough to allow for unlimited construction design applications and to accomplish attractive esthetic exterior and interior designing.

It is still yet a further object of the present invention to provide an end product that is substantially energy efficient and that requires little or no maintenance regardless of weather conditions or the physical location of the building.

It is another object of the present invention to provide a construction process that requires the use of only a specialized glue for all permanent connections, as opposed to most construction processes that currently require nails, screws, or other forms of hardware to be used to inter-connect the materials used in the construction process.

It is a further object of the present invention to provide a building process that uses the same materials, and thus available from a single supplier, as opposed to conventional building processes that require several different types of materials, such as wood studs, plywood, drywall, various ceiling tiles, masonry products, roofing materials and the like.

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6, are sought to be invoked to define the invention(s), the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. §112, paragraph 6. Moreover, even if the provisions of 35 U.S.C. §112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DESCRIPTION OF PREFERRED EMBODIMENTS

The present invention is a building system and components that are useful for the quick and easy construction of buildings and the like. The process starts with a foundation for the structure and works upwards in a logical and systematic manor developing the framework, walls, floors, basic utility service connections, ceilings and roofing system progressively and logically so that when the structure's roof is finished there is nothing else to do except install the utilities, such as plumbing, electric, ventilation, and the like, and the decorating features, such as painting, paneling, interior closets, and the like. In a preferred embodiment, the system uses "color coded" building materials and the simple design of the "special building materials" that are described herein.

There are several benefits of the present invention over prior art systems. The cost of materials are less than the cumulative costs for the materials necessary for conventional wood framed construction because there are a lot of different types of products necessary for existing constructions but only one type of material is required for the present invention. The "time factor" for current construction is much longer than that which applies to the present design, because the present design is extremely simplified and all the materials are already exactly the proper lengths. The amount of time required for construction will be at least 50% less than that required for current construction methods. And the design of the present invention is not limited to housing construction, but applies to any type of building from barns and garages to five story apartment complexes.

Figure 1:
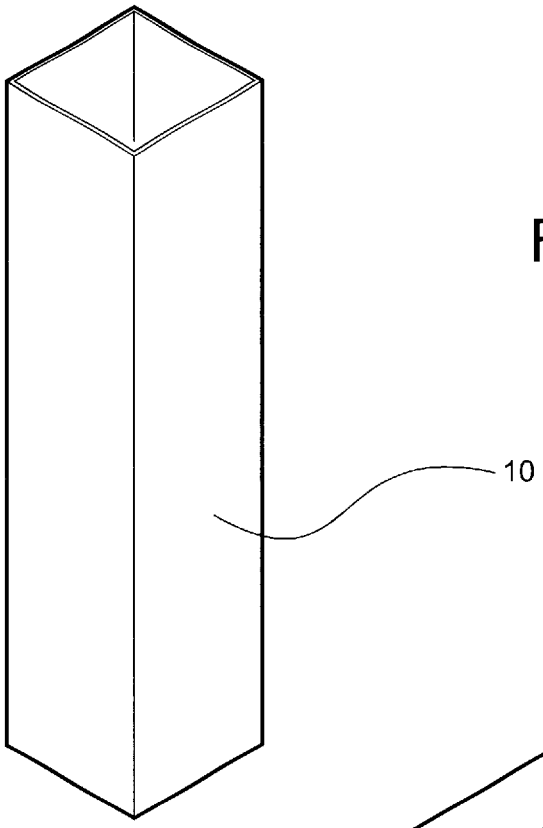
FIG. 1 is a view of a pillar support according to the present invention.
Figure 2:
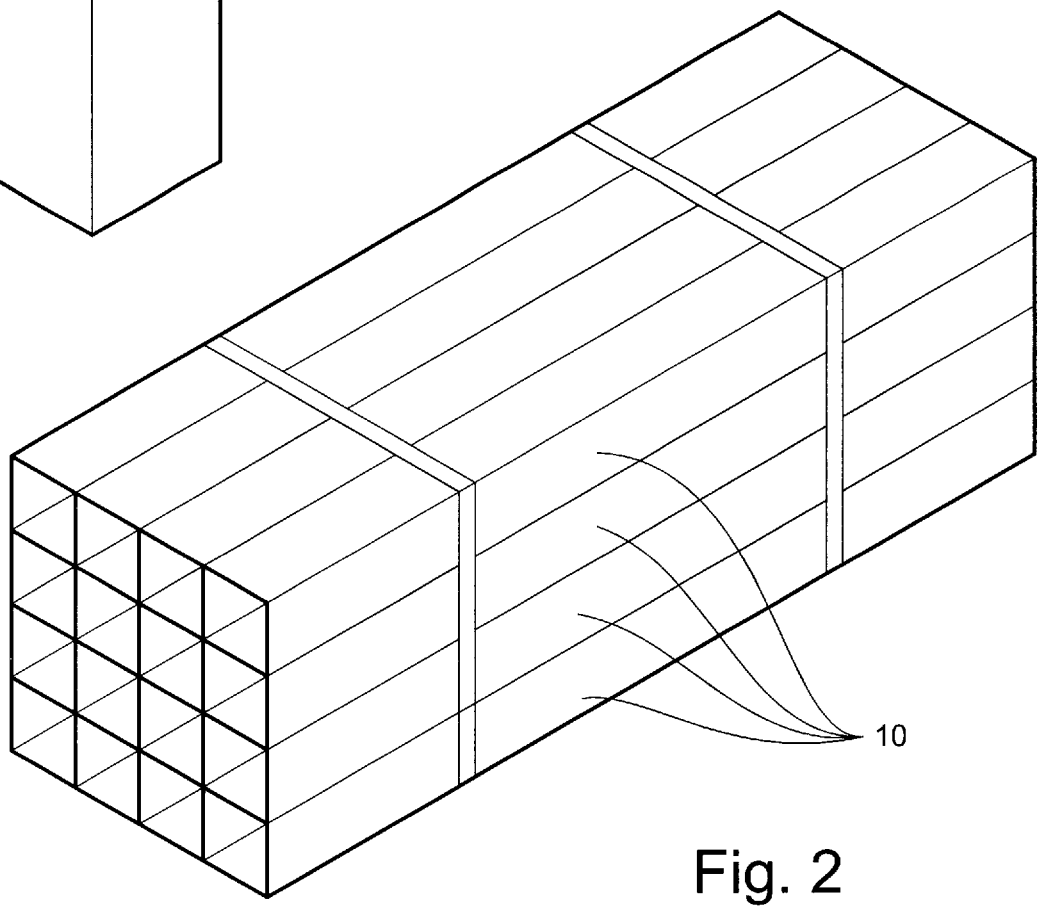
FIG. 2 is a bundle of pillar supports according to the present invention.

Referring now to the drawings for a more complete understanding of the invention, FIG. 1 is a view of a pillar support 10 according to the present invention. The pillar support 10 a hollow tubular structure, preferably a hollow tube with a generally square or rectangular cross section. Most preferably, the pillar supports 10 are 8 inches by 8 inches square hollow tube-like structures and come in 8 foot long (or longer) sections. Both ends of the pillar support 10 are open to receive inserted materials. As illustrated in FIG. 2, these pillar supports may be conveniently packaged in space saving bundles for easy shipment. The building ultimately constructed will be secured to the ground by use these pillar-supports 10. The pillar supports 10 are cut to the required length on site.

Figure 3:
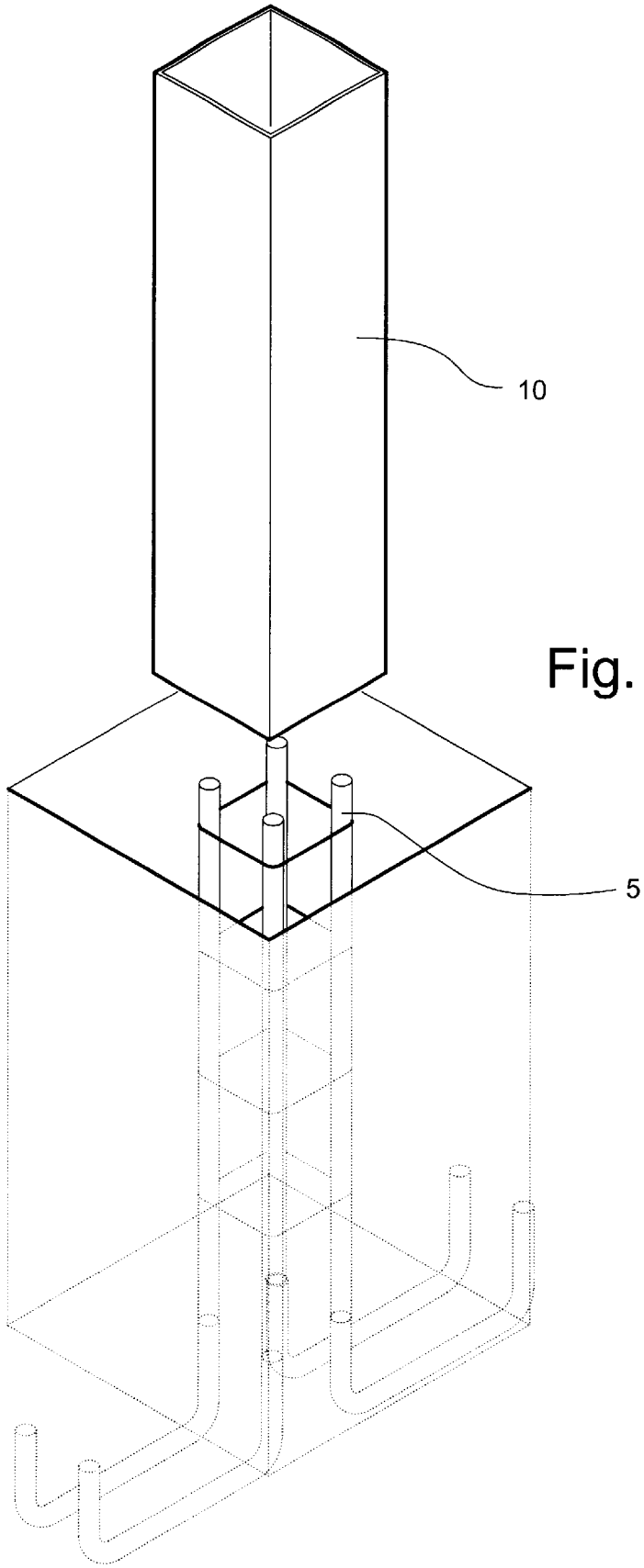
FIG. 3 illustrates how a pillar support is inserted into a pre-dug hole and onto a REBAR structure according to the present invention.
Figure 4:
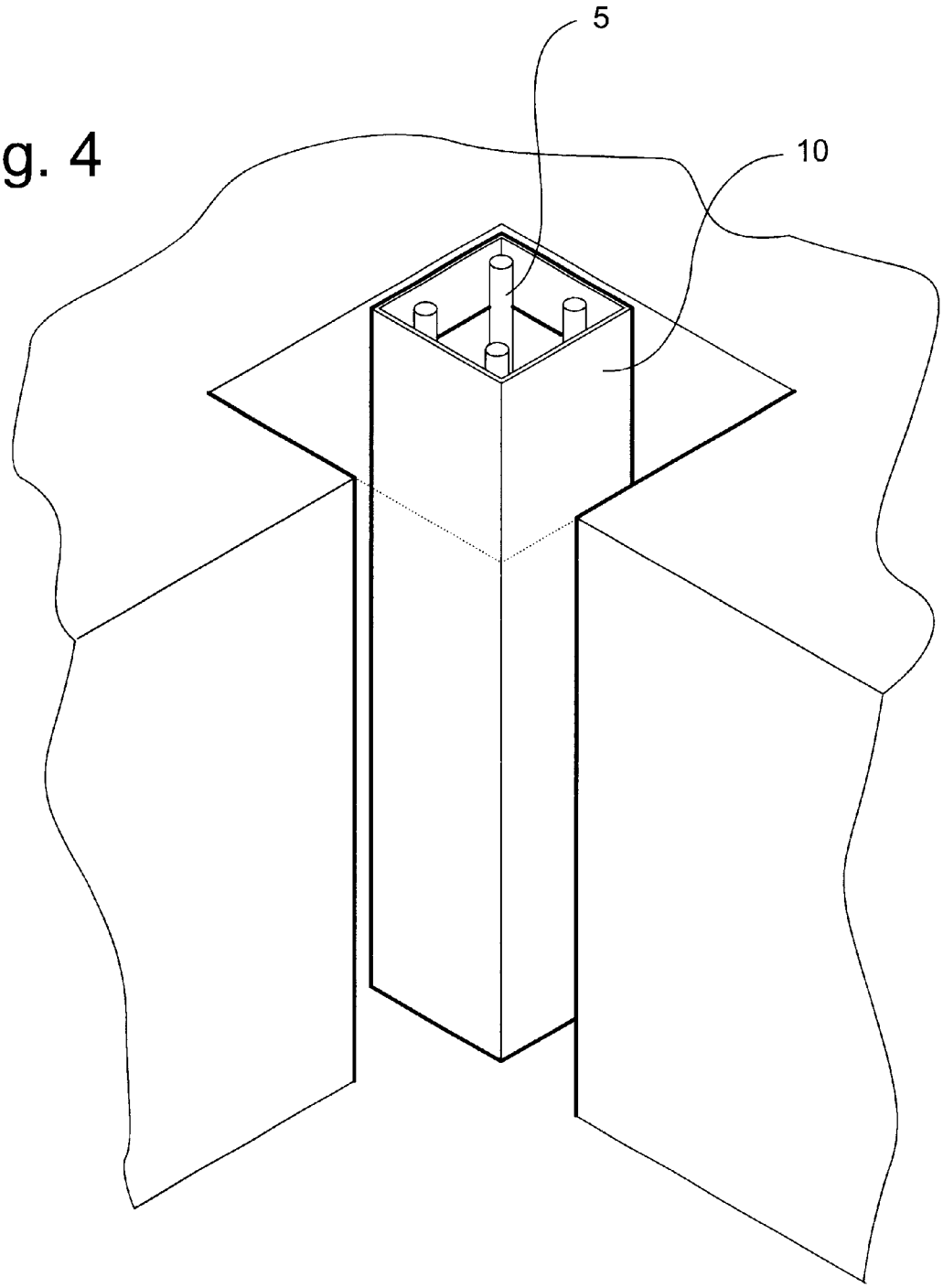
FIG. 4 illustrates the pillar support after insertion into the pre-dug hole, according to the present invention.

As illustrated in FIGS. 3 and 4, the pillar supports 10 are installed into pre-dug holes into the ground, said holes being at least 3 feet in depth and having reinforcing bars 5 or (REBAR) steel rods wired together to form an "anchor". The hole, with the pillar support 10 and REBAR structure 5 in place, is then filled with concrete leaving at least 5 inches of the top of the pillar support 10 exposed for the attachment of a pillar support top 15. See FIG. 5.

Figure 5:
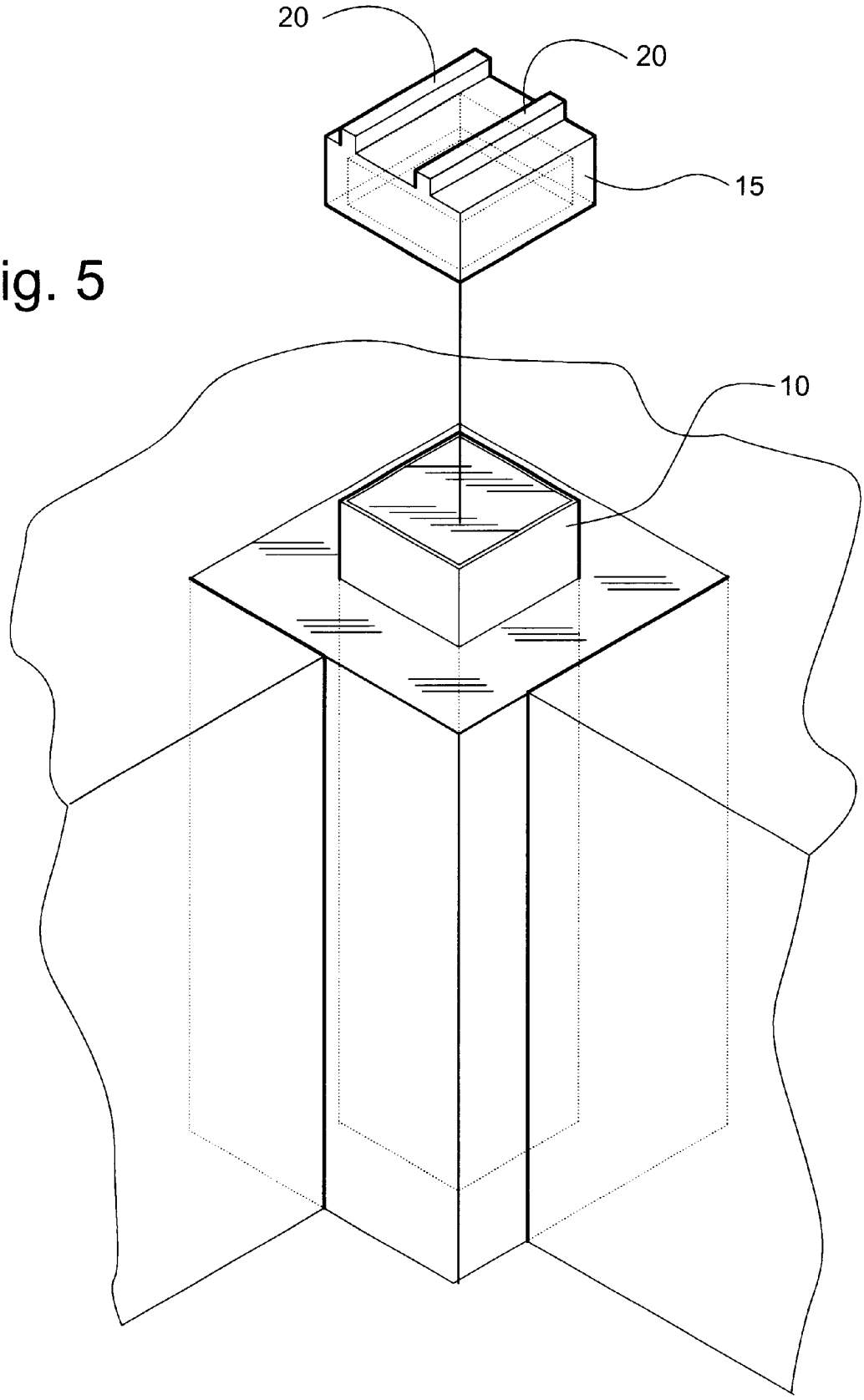
FIG. 5 illustrates the pillar support top according to the present invention.
Figure 6:
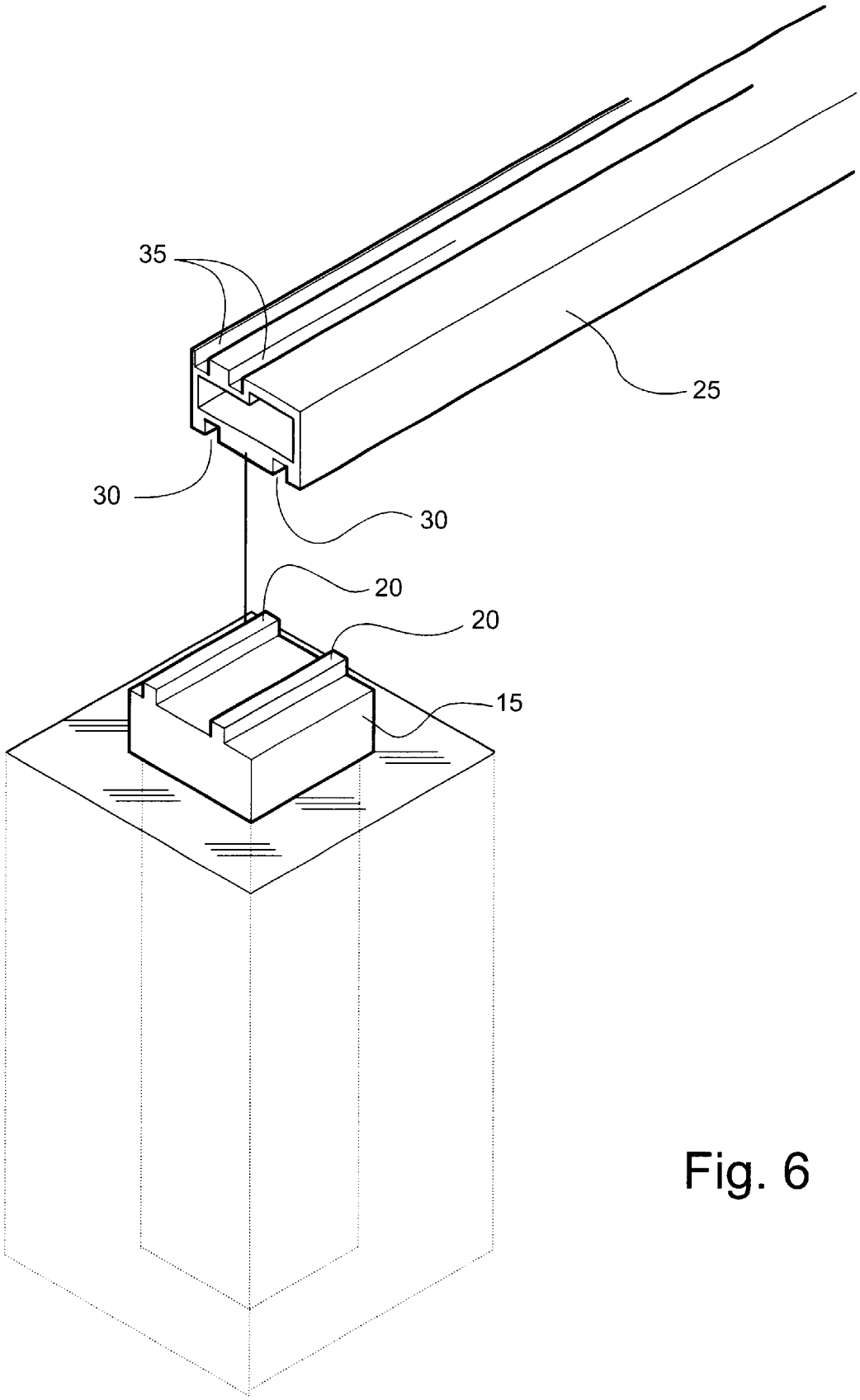
FIG. 6 illustrates the main support beam according to the present invention.
Figure 7:
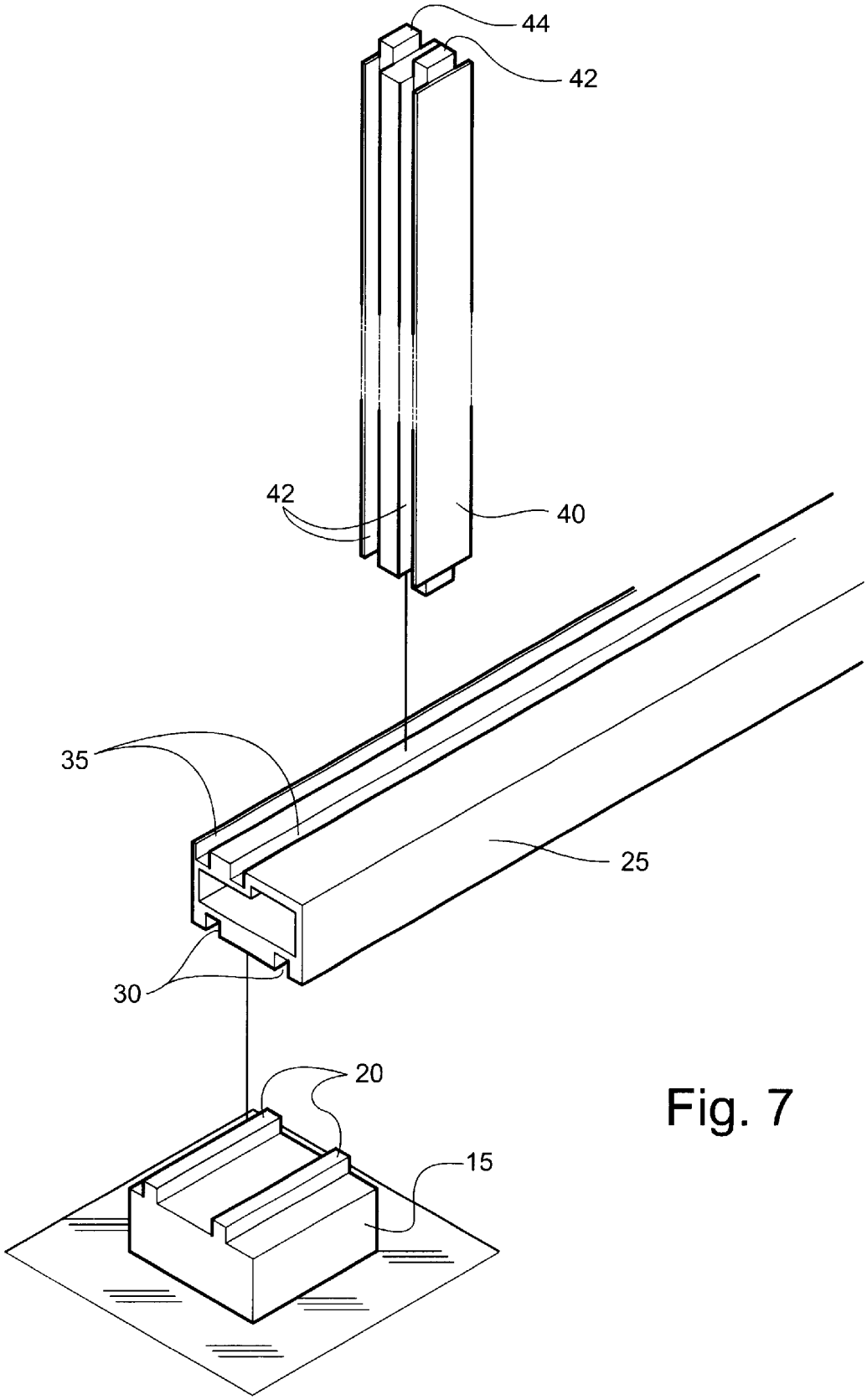
FIG. 7 illustrates how the main support beam attaches to the pillar support tops according to the present invention.
Figures 8, 9:
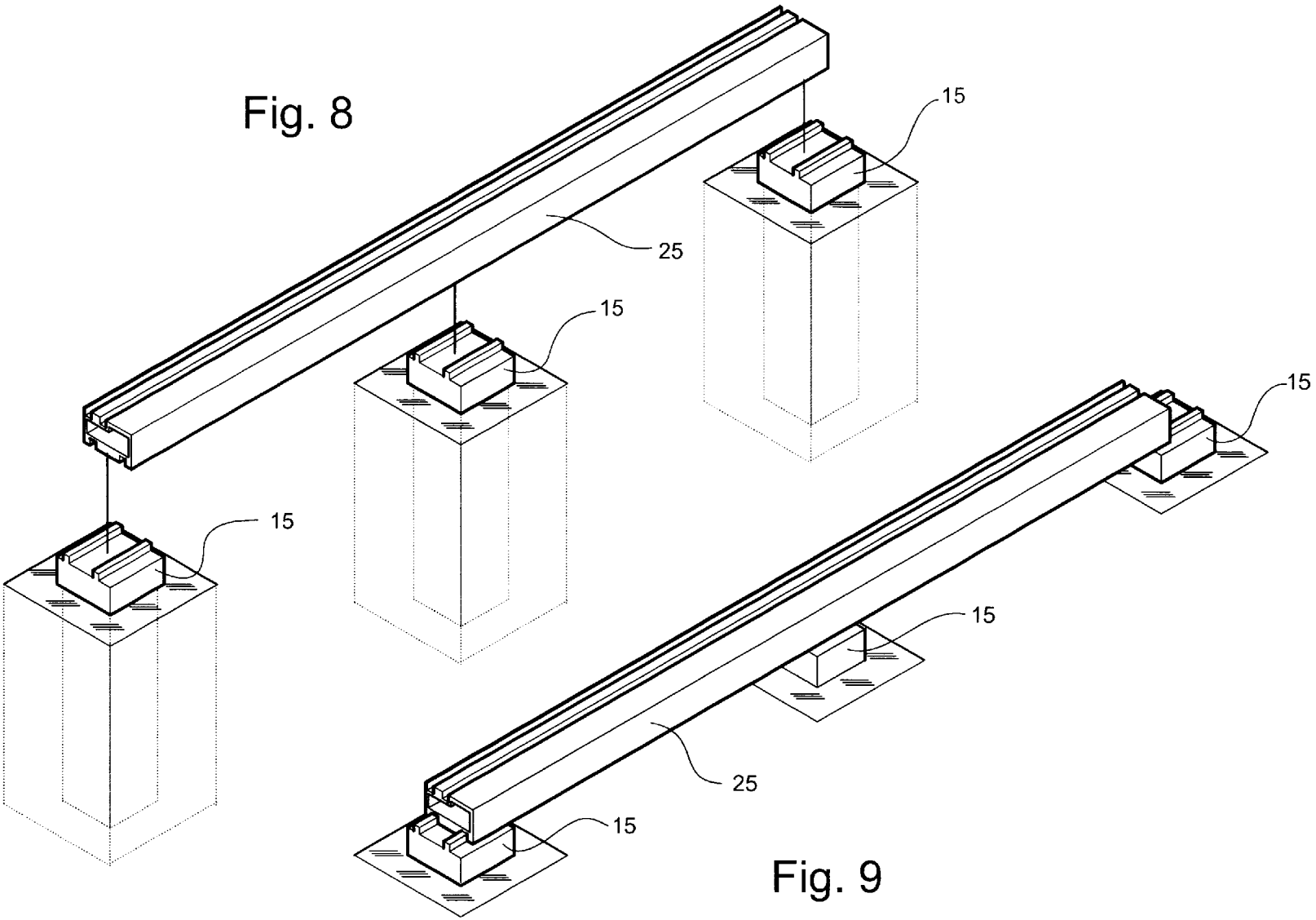
FIG. 8 illustrates the main support beam after attachment to the pillar support tops.
FIG. 9 illustrates how a vertical support attaches to the basic support beam according to the present invention.

After the pillar supports 10 have been properly installed at all major stress and support points in the building plans, the pillar support tops 15, illustrated in FIG. 5, are attached to the pillar supports 10. The pillar support tops 15 are caps that have a receiving cavity that closely matches the outside size and shape of the top of the pillar supports 10. Located on a top surface of the pillar support tops 15 are vertical ribs 20 that extend between two opposite sides of the pillar support top 15. The ribs 20 are preferably 1 inch by 1 inch in cross sectional size. The pillar support tops 15 are attached to the pillar supports 10 by gluing them onto the pillar supports 10 with the vertical 1 inch by 1 inch ribs 20 running parallel to the intended wall's borders. This assures a secure attachment to the ground.

Next, main support beams 25 are attached by an adhesive onto the top of the pillar support tops, FIGS. 6, 7, 8, and 9. The main support beams 25 are substantially rectangular in cross section. There are two bottom grooves 30 that extend longitudinally from one end of the main support beam 25 to the opposite end, on a bottom surface. The two bottom grooves 30 are preferably symmetrically located on the bottom surface. Located on a top surface are two top grooves 35. The two top grooves 35, like the two bottom grooves 30, extend from one end of the main support beam 25 to the opposite end, but on the top surface. The two top grooves 35, however, are not symmetrically located on the top surface, but are located predominantly to an outside edge. The ribs 20 on the pillar support tops 15 fit into two bottom grooves 30 located in the main support beams 25 in such as way that the two top grooves 35 are located on the outer-most side of the building's wall. This forms the "foundation for the building's structure". This also provides for the secure attachment of the rest of the building's structure to the pillar supports 10 and therefore to the ground.

Figure 10:
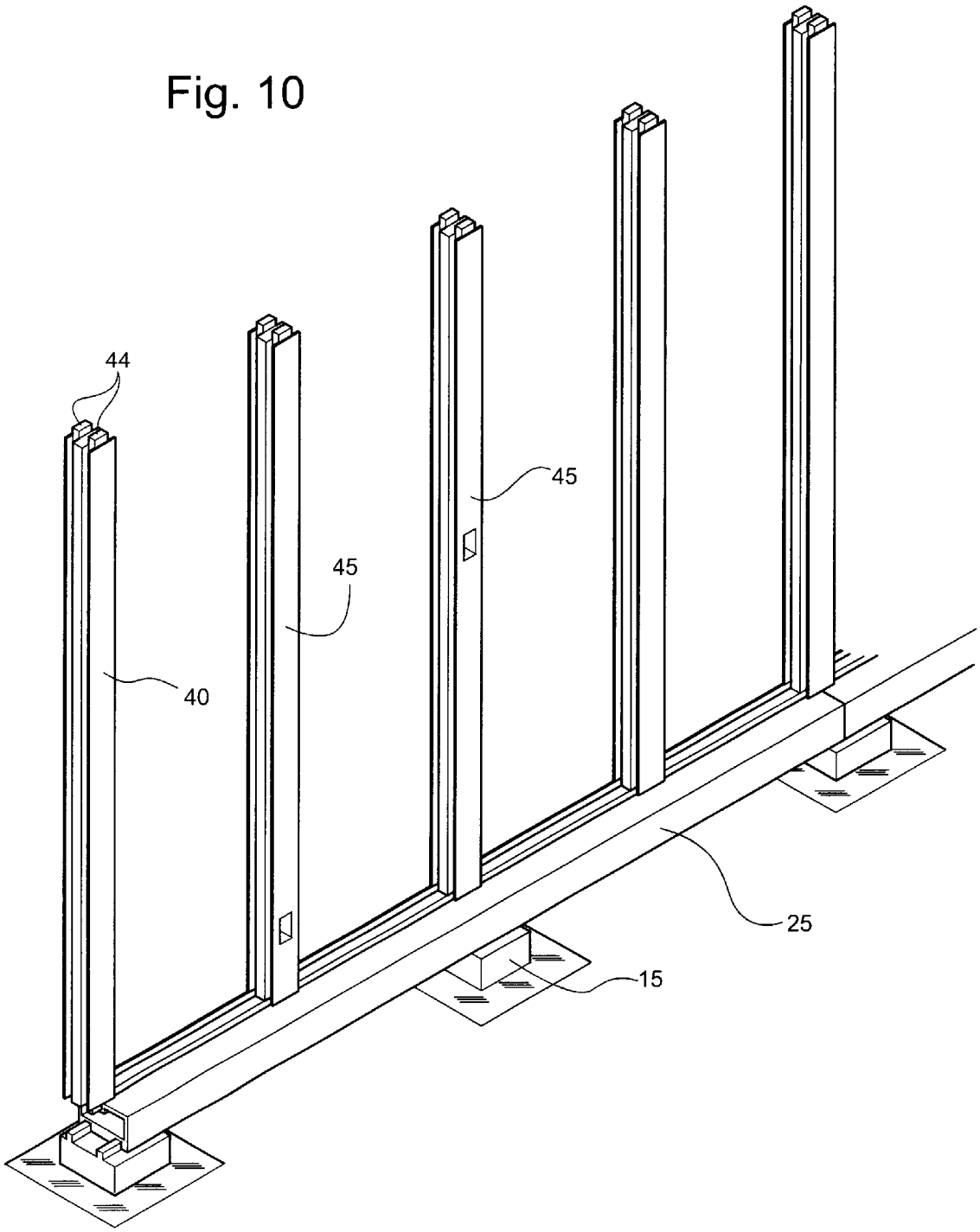
FIG. 10 illustrates several vertical supports attached to a main support beam.
Figure 16:
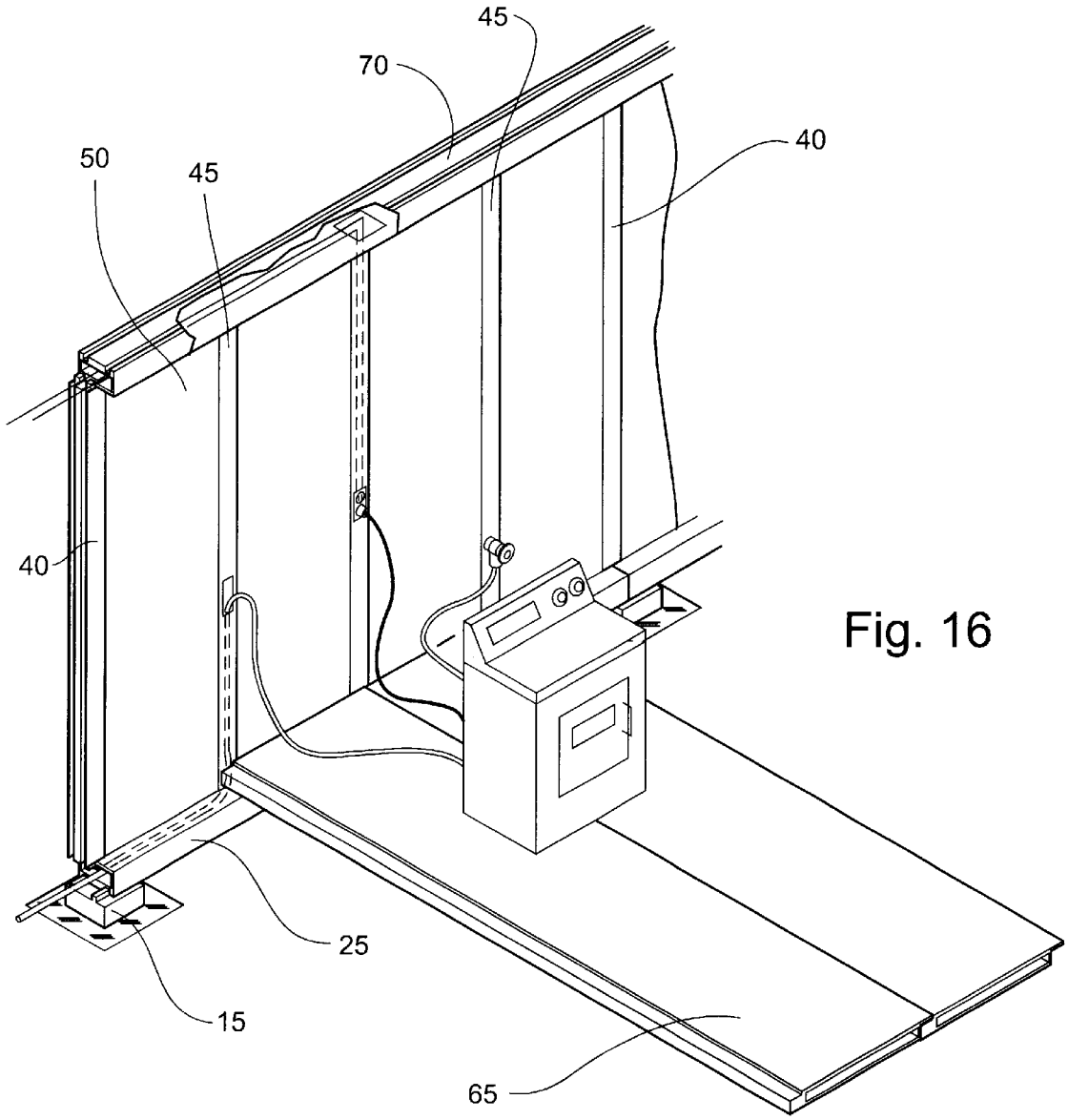
FIG. 16 illustrates a wall that includes special supports for plumbing and electrical needs.

Next, all basic vertical supports 40, which are preferably 4 inches by 4 inches, and special supports 45, as illustrated in FIGS. 10 and 16, that are designated in the building plans for utility, such as electric and plumbing, connections are attached to the main support beams 25 at 2 foot intervals, on-center, by means such as adhesives. The basic vertical supports 40 are substantially rectangular in shape with two sets of grooves 42, on opposite sides, that extend from one end of the basic vertical support 40 to the opposite end. Additionally there are two sets of ribs 44, one set located on each opposite end of the vertical support 40. The special vertical supports 45 have the grooves 42 and the ribs 44 and include a structure for plumbing connections, which have a plumbing conduit installed in the center with a universal connector on top and in a plumbing outlet junction box that opens to the interior of the building. Another embodiment of the special vertical supports 45 is for electrical connections. This embodiment includes an electrical outlet box that may be located either adjacent to one end or substantially in the middle of the special support 45. As with the plumbing version, there is a conduit installed in the center with a universal connector on top and in the electrical outlet junction box. When attaching the vertical supports 40 and 45 to the basic support 25, the ribs 44 located at one end of the vertical supports 40 and 45 are fit into the two top grooves 35 located on the top surface of the main support beam 25 and glued into place. This provides the vertical support for the building as well as the receptacles (the grooves 42) for interior and exterior wall panels, 50 and 55.

Figure 11:
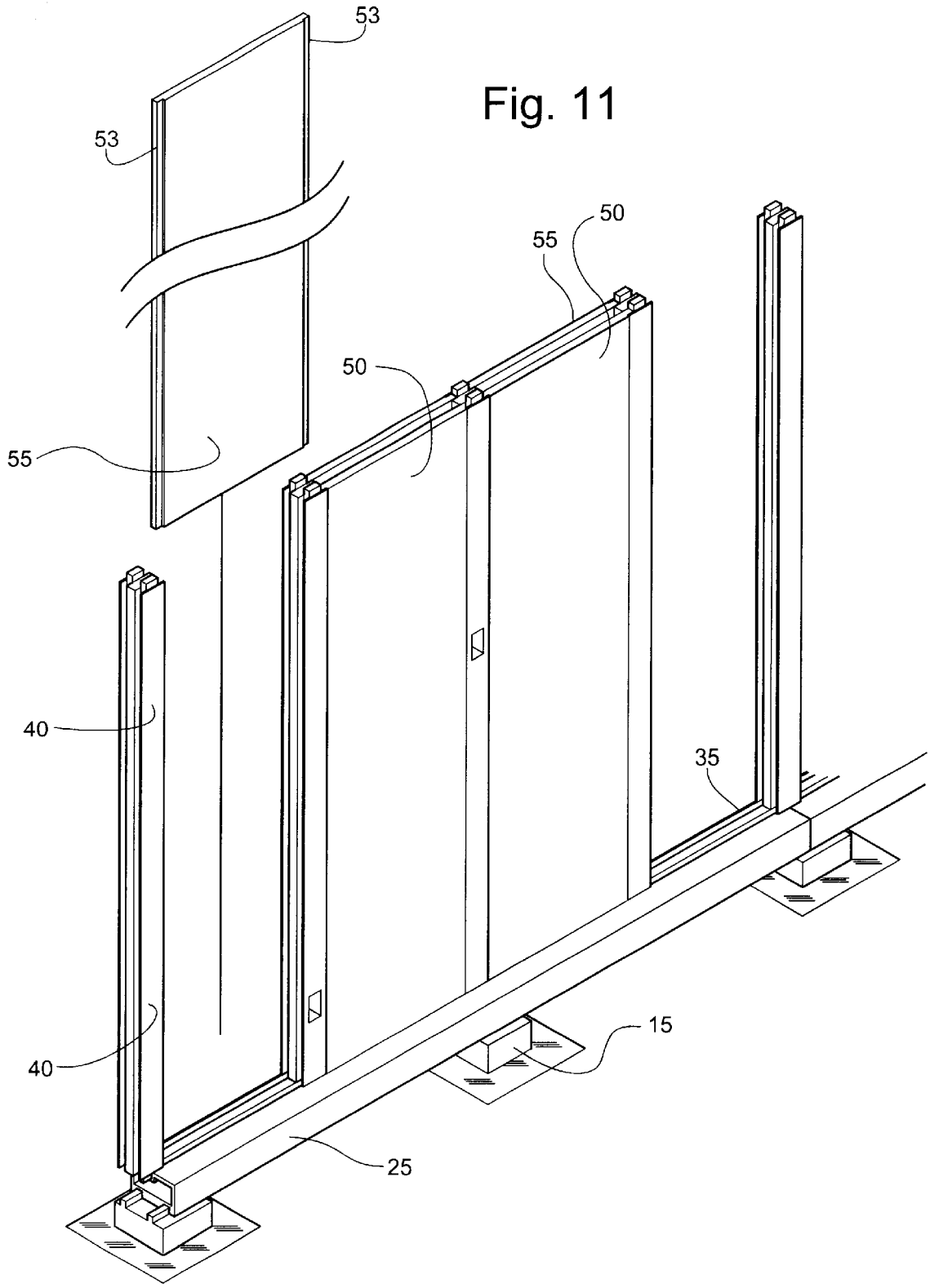
FIG. 11 illustrates how wall panels according to the present invention are attached to the vertical supports and major support beam.
Figure 12:
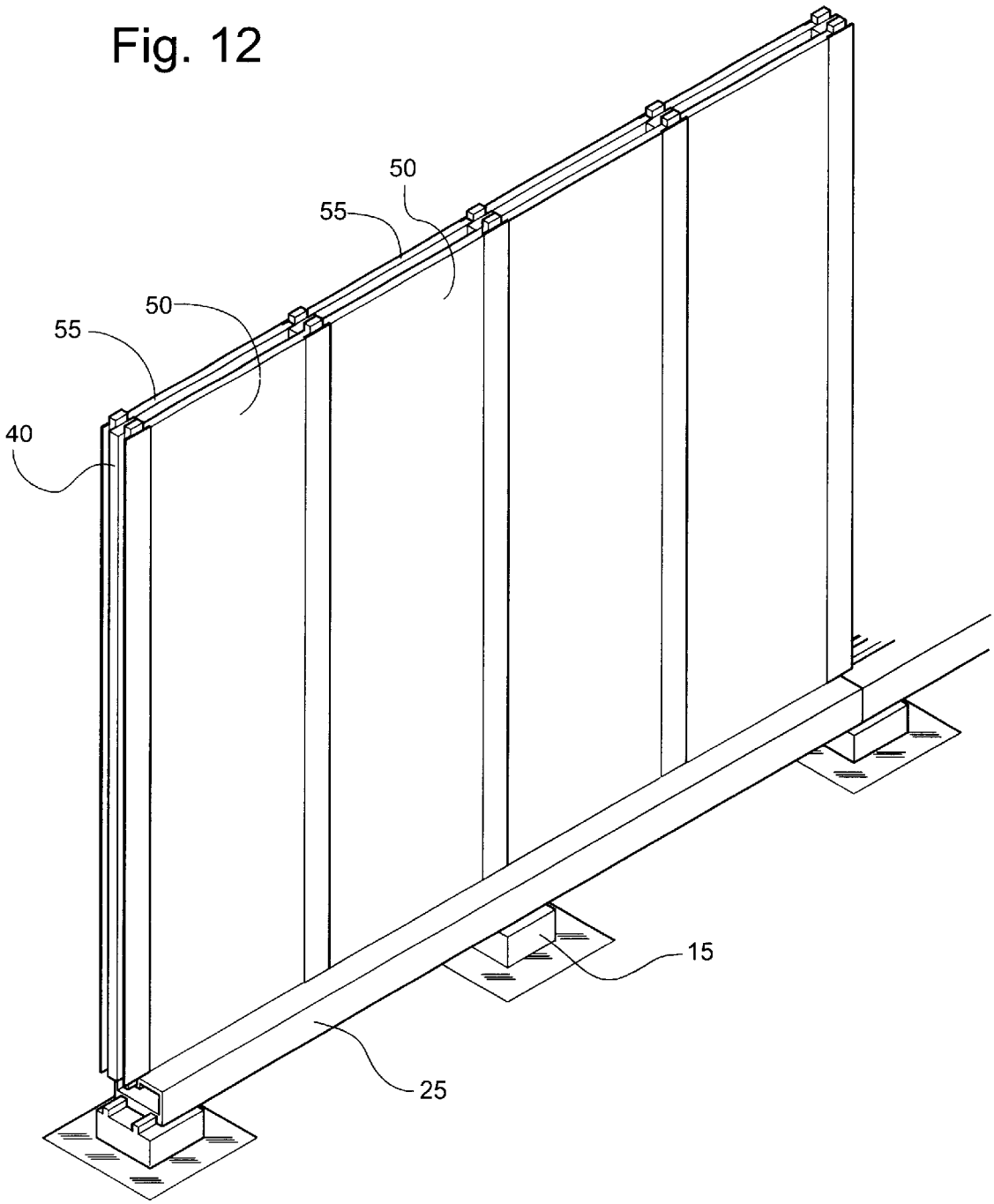
FIG. 12 illustrates an exterior wall with wall panels in place.

As illustrated in FIGS. 11 and 12, the internal as well as exterior wall panels, 50 and 55, are then attached to the walls by applying glue to the grooves 42 and 35, aligning a male "lip" 53 located on the edges of the panels, 50 and 55, with the grooves 42 located on the sides of the vertical and special vertical supports 40 and 45, and "sliding" the wall panels 50 and 55 place. This increases stability and building strength as well as providing an insulated wall system with all basic utility service connections already in place. Further, since there is a space between the internal and exterior wall panels, 50 and 55, additional insulation or support materials may be incorporated into the structure.

Figure 18:
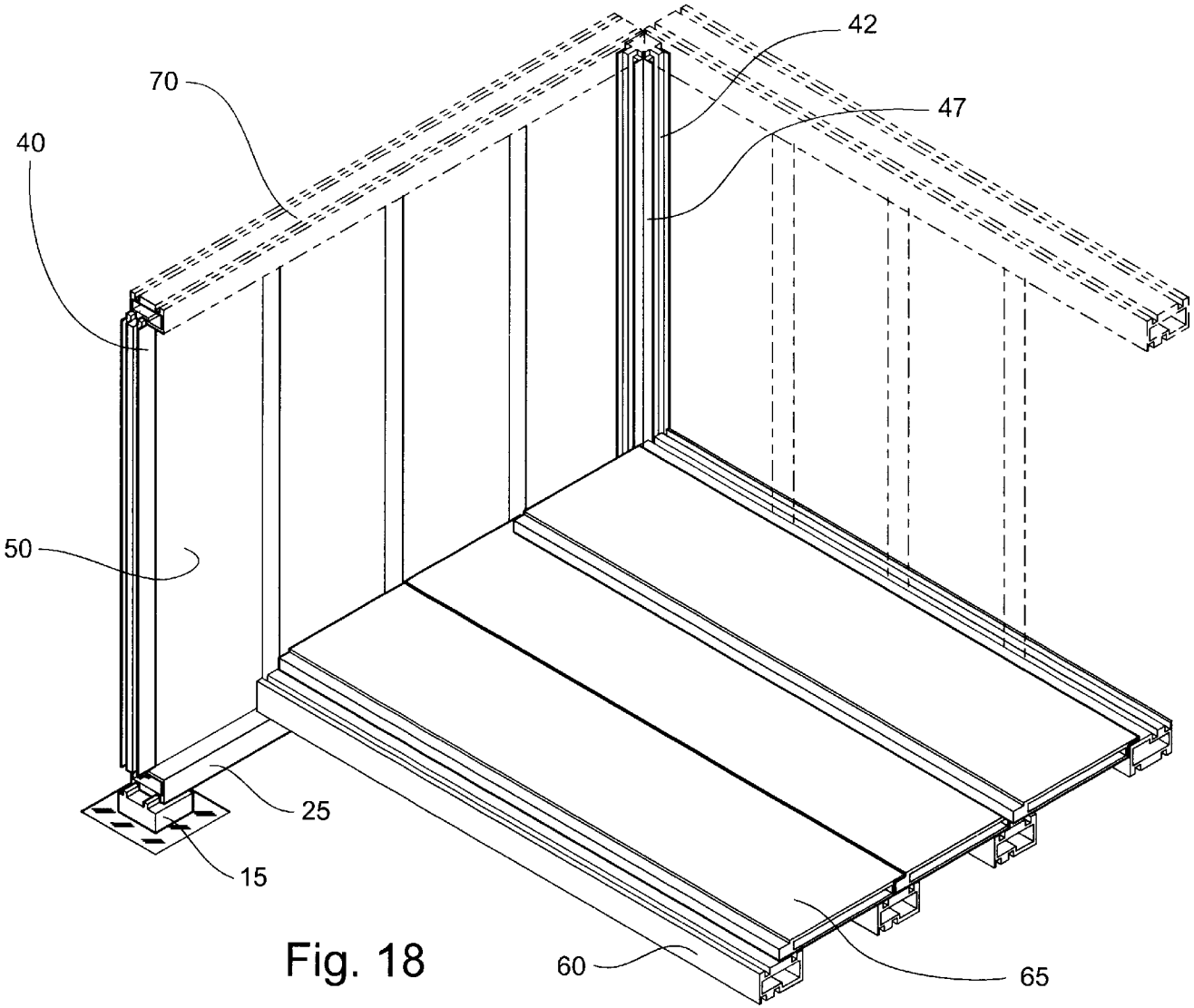
FIG. 18 illustrates a second wall (in dashed lines) connected to a corner post.
Figure 26:
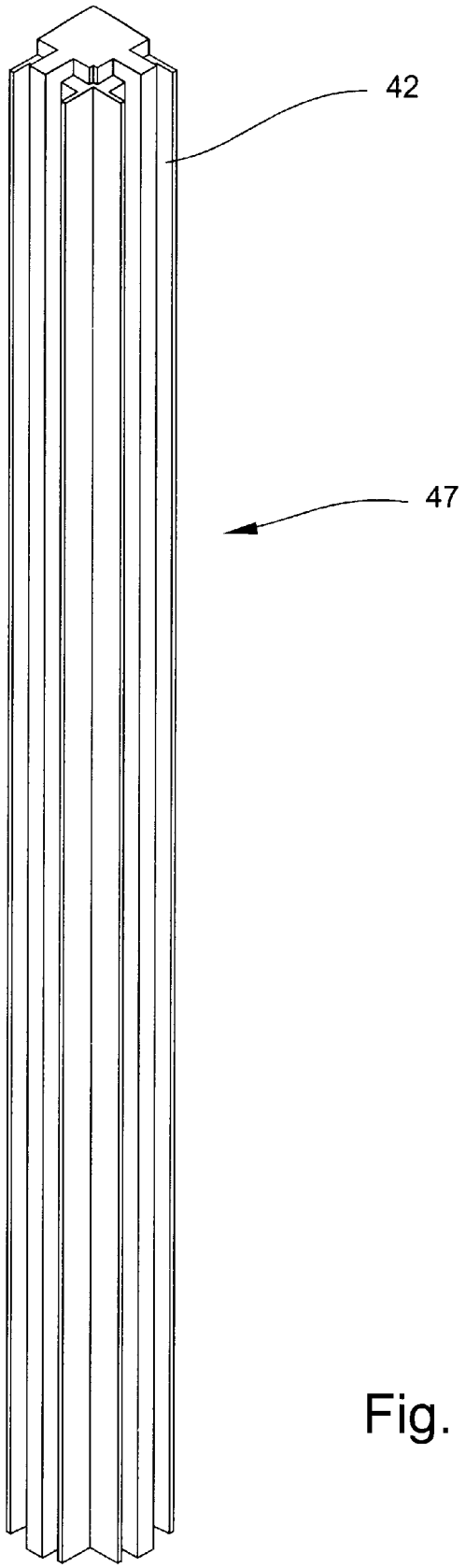
FIG. 26 illustrates a corner joist.

Exterior corners are created using a corner post 47 at the corner of the structure, as illustrated in FIG. 18. The corner post 47, shown in FIG. 26, has two sets of grooves 42 and ribs 44, like the vertical support 40, however instead of being on opposite sides, the grooves 42 of the corner post 47 are on adjacent sides. In this manner, a 90-degree corner may be constructed. Shapes other than square or rectangular may be used for the corner post 47 to create corners with different angles and still fall within the scope of the present invention. In order to complete the corner structure a matching corner cap (not illustrated) with matching grooves and ribs is used to fill in the three-sided gap at the top of the corner. This corner cap may have any shape, as long as it snugly fits into, and seals, the top corner void.

Figure 17:
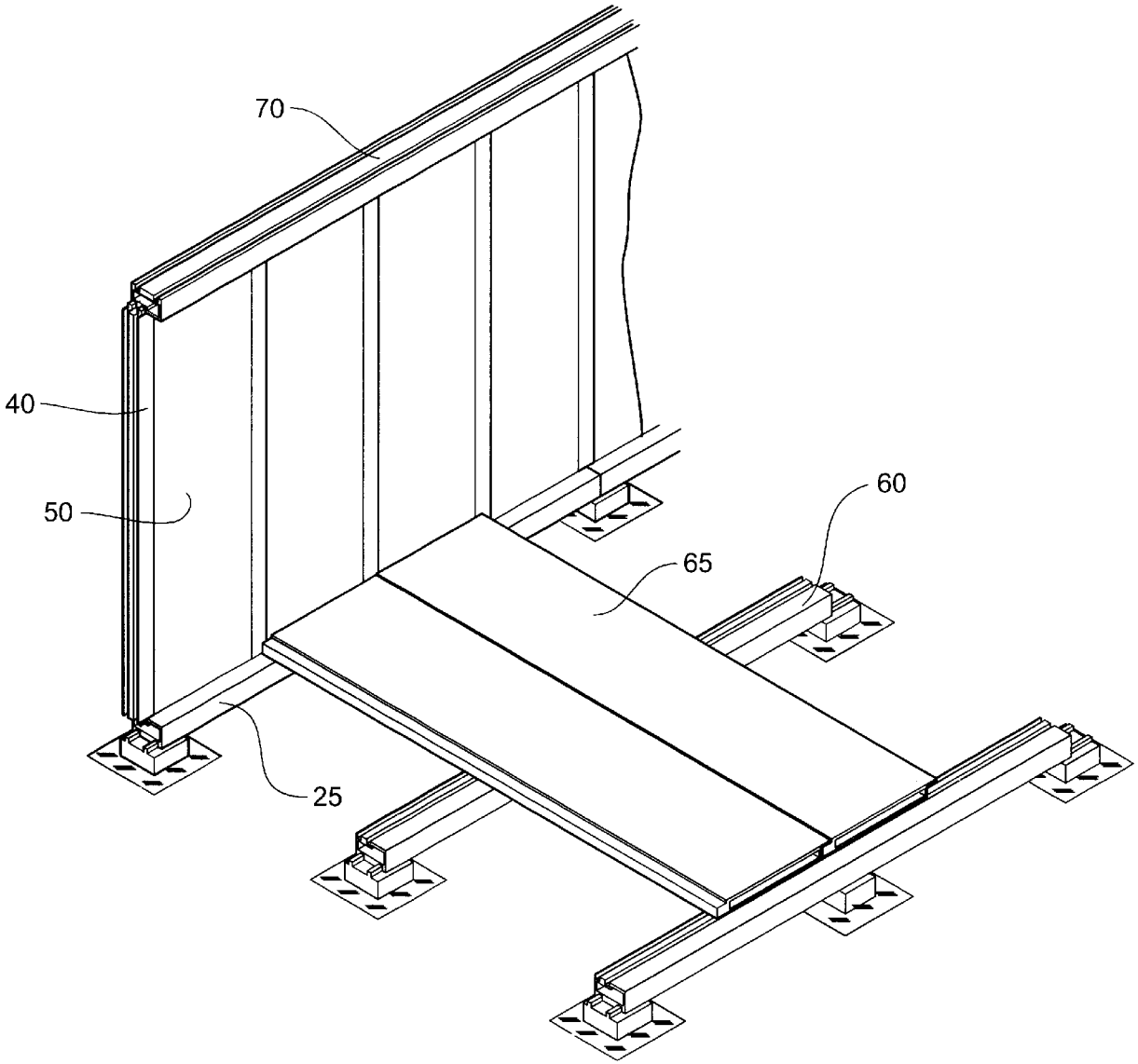
FIG. 17 illustrates the how the floor joists are placed to support the floor panels.

Next, floor joists 60, as illustrated in FIG. 17, are installed by laying the floor joists 60 laterally across the main support beams 25 and gluing into place. The floor joists 60 are secured into place on 2-foot centers starting in the right front corner of each room. The floor joists 60 provide the strength and support for floor panels 65 and create an even more secure building structure that is firmly attached to the ground. The floor joists 60 are pieces that have substantially rectangular cross section, said pieces have two bottom grooves 30 that extend longitudinally from one end to the opposite end on a bottom surface and two top grooves 35 that extend from one end to the opposite end on a top surface, said two bottom grooves 30 further adapted to receive the two ribs 20 on the pillar support tops 15.

Figure 13:
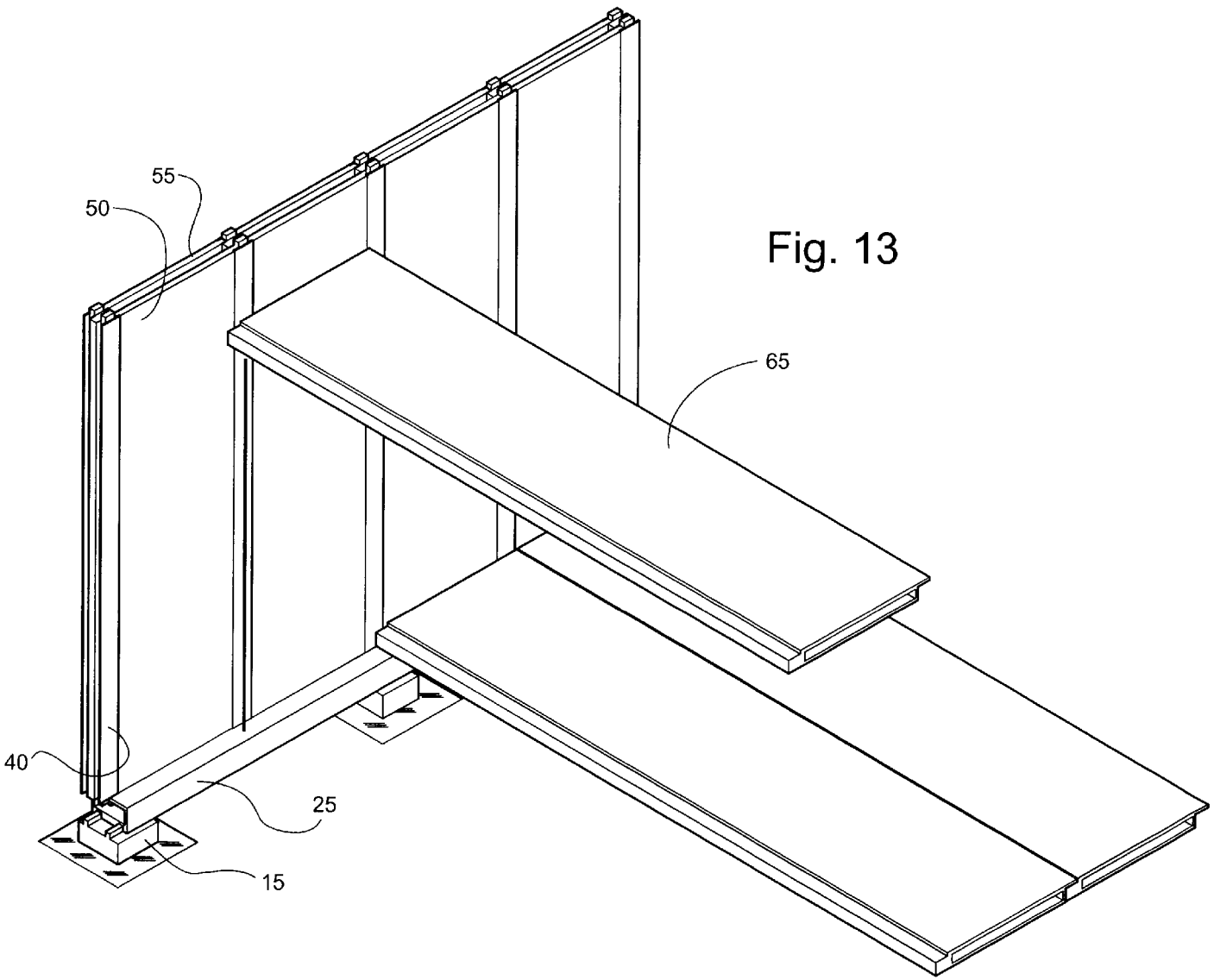
FIG. 13 illustrates the installation of floor panels according to the present invention.

After the floor joists 60 are installed and secured into place, the floor panels 65 are positions over the floor joists 60 and glued into place, starting in the right front corner of each room, see FIG. 13. The floor panels 65, which preferably have a first lip near a top surface along one edge and a second lip near a bottom surface along an opposite edge such that the two lips are adapted to overlap when placed upon the floor joists 60, are secured by gluing, to the floor joists 60 and to adjacent floor panels 65 as they are installed. The resulting floor structure is designed to be very strong and thermally comfortable, due to the insulation that is incorporated into the floor panels 65 at the factory. The floor panels 65 provide a quality surface for any covering that the owner chooses and will never squeak or crack as some conventional floor systems do.

Figure 14:
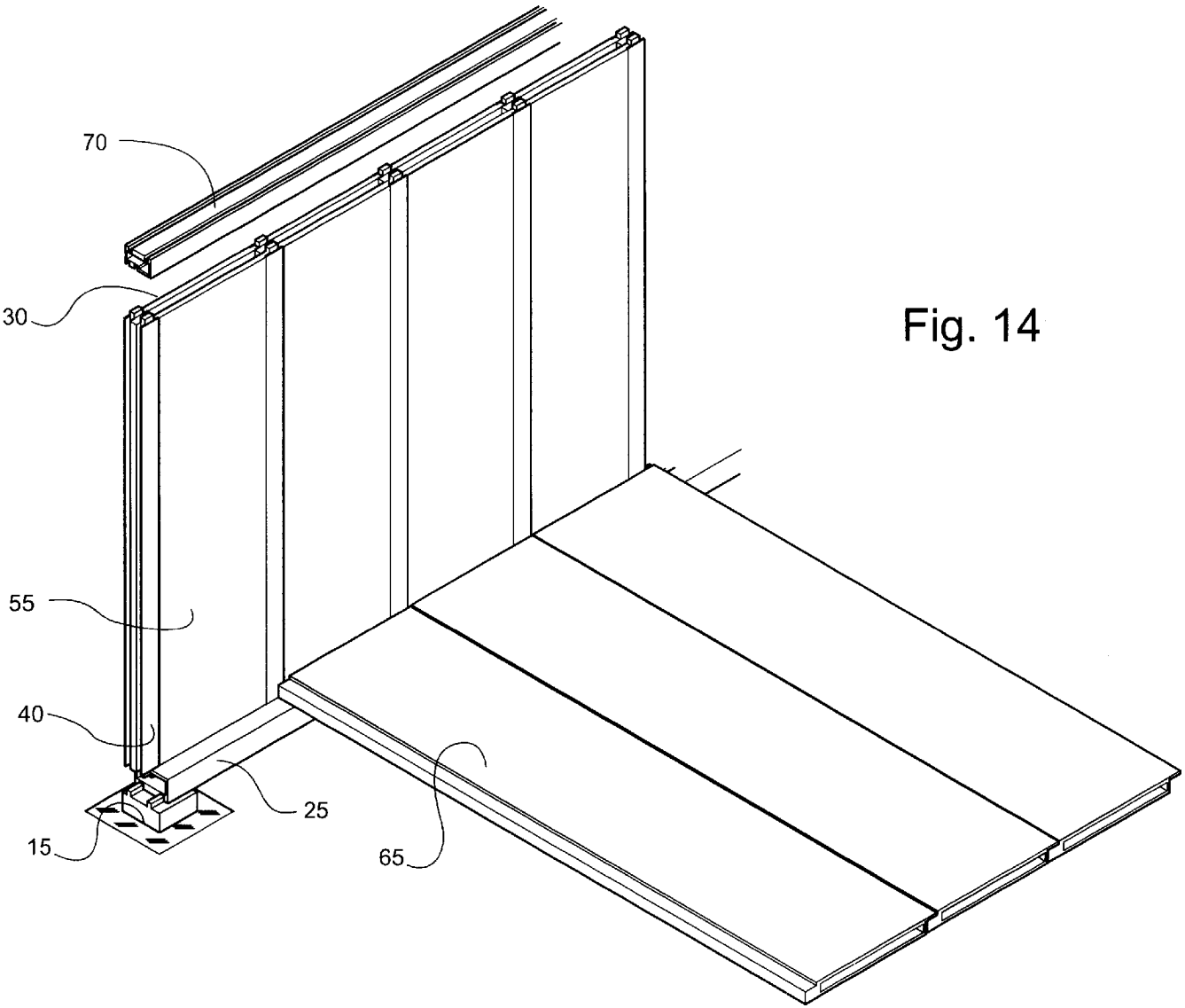
FIG. 14 illustrates the installation of the wall top plate according to the present invention.
Figure 15:
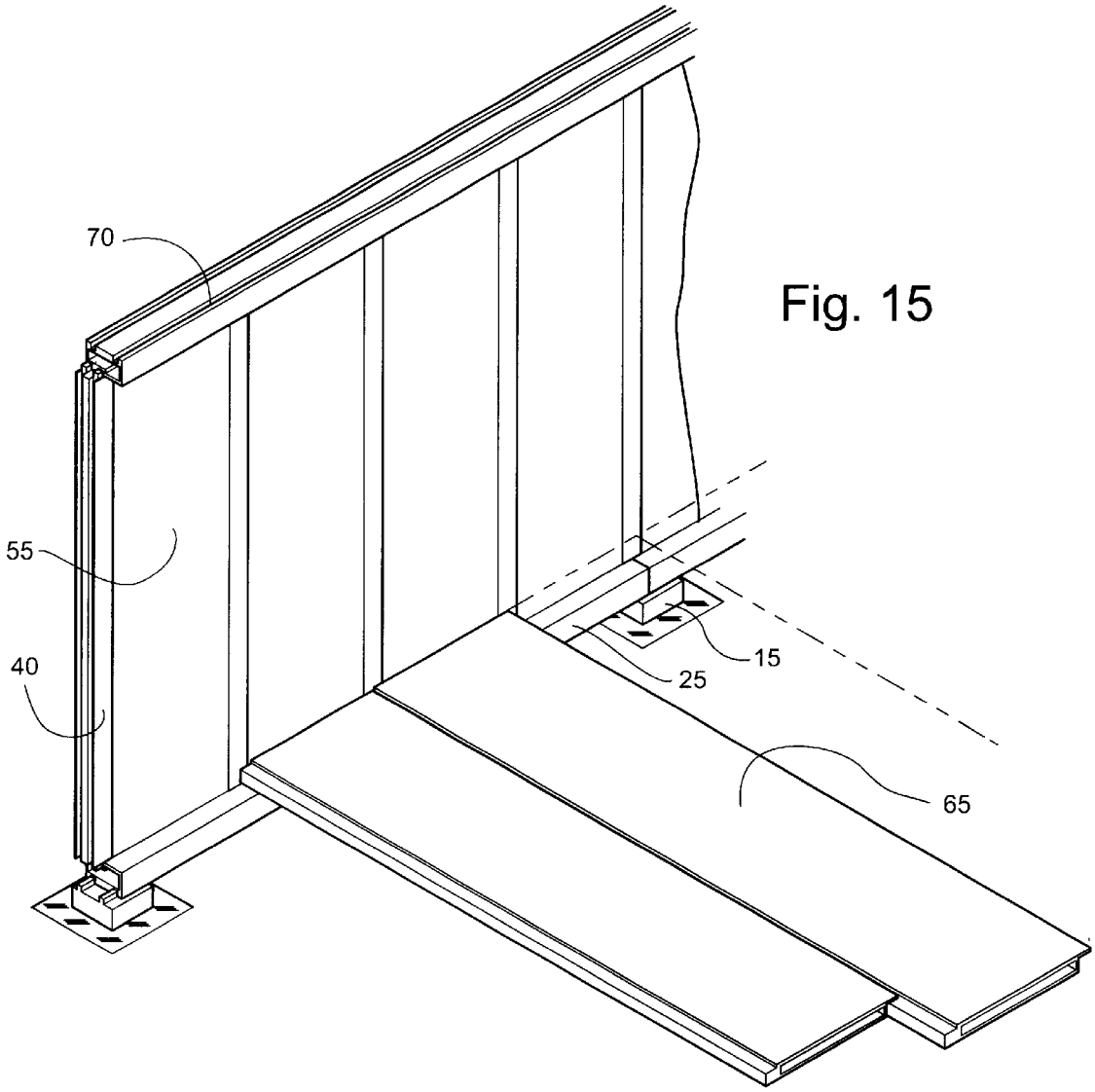
FIG. 15 illustrates the wall top plate after installation according to the present invention.

After the floor panels 65 are installed, a wall top plate 70 is attached to the walls by simply securing the wall top plate 70 laterally on top of the vertical supports 40 and 45 and projecting lip of the wall panels 50 and 55 and attaching them in place over the lips on the wall panels 65, see FIGS. 14 and 15. The wall top plate is preferably the same structure as the main support beams 25, previously described above. All seams and connections are glued in place thus making for an extremely strong structure. This results in a totally sealed and connected structure from the ground to the roof. By using glue to secure all seams of the structure, or other sealants, there is no room for insects, rodents or even large volumes of air to penetrate the building.

Figure 19:
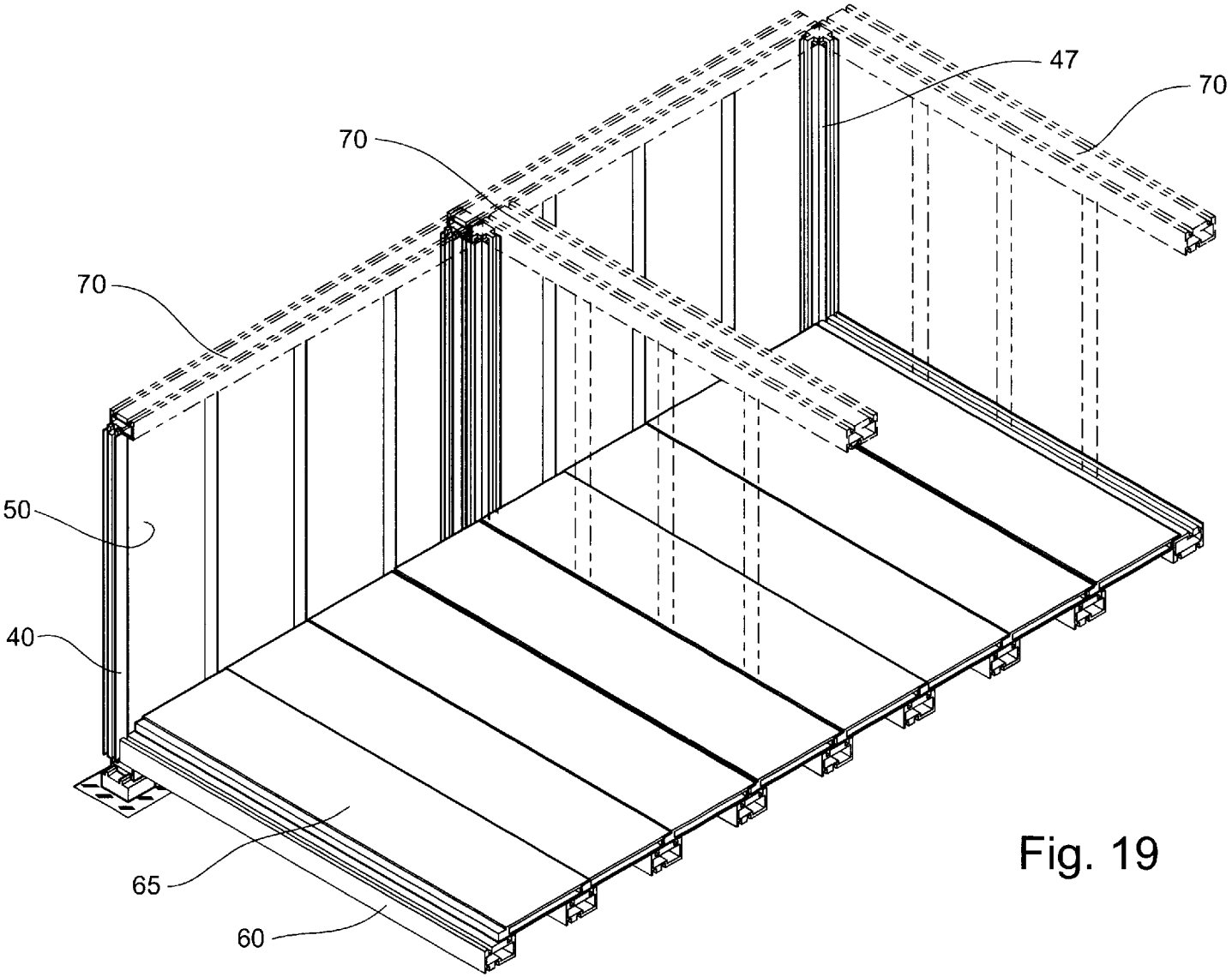
FIG. 19 shows the addition of an interior wall (in dashed lines).

As illustrated in FIG. 19, additional interior walls may be added attaching vertical supports 40 along the interior wall line and using interior wall panels 50, on both sides. A wall top plate 70 is also added to seal the top of the interior wall.

Figure 20:
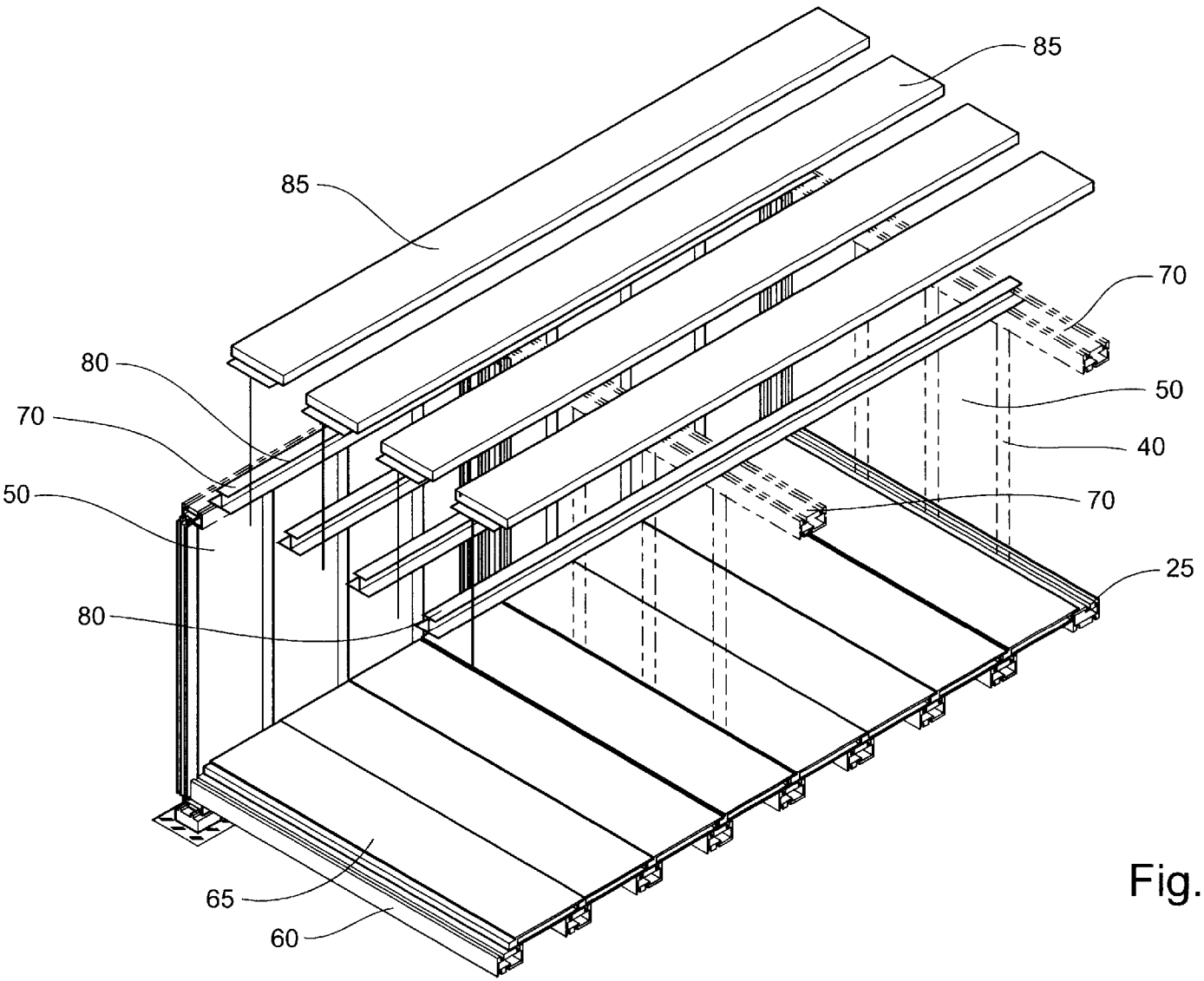
FIG. 20 shows the addition of ceiling rafters and ceiling panels.
Figure 21:
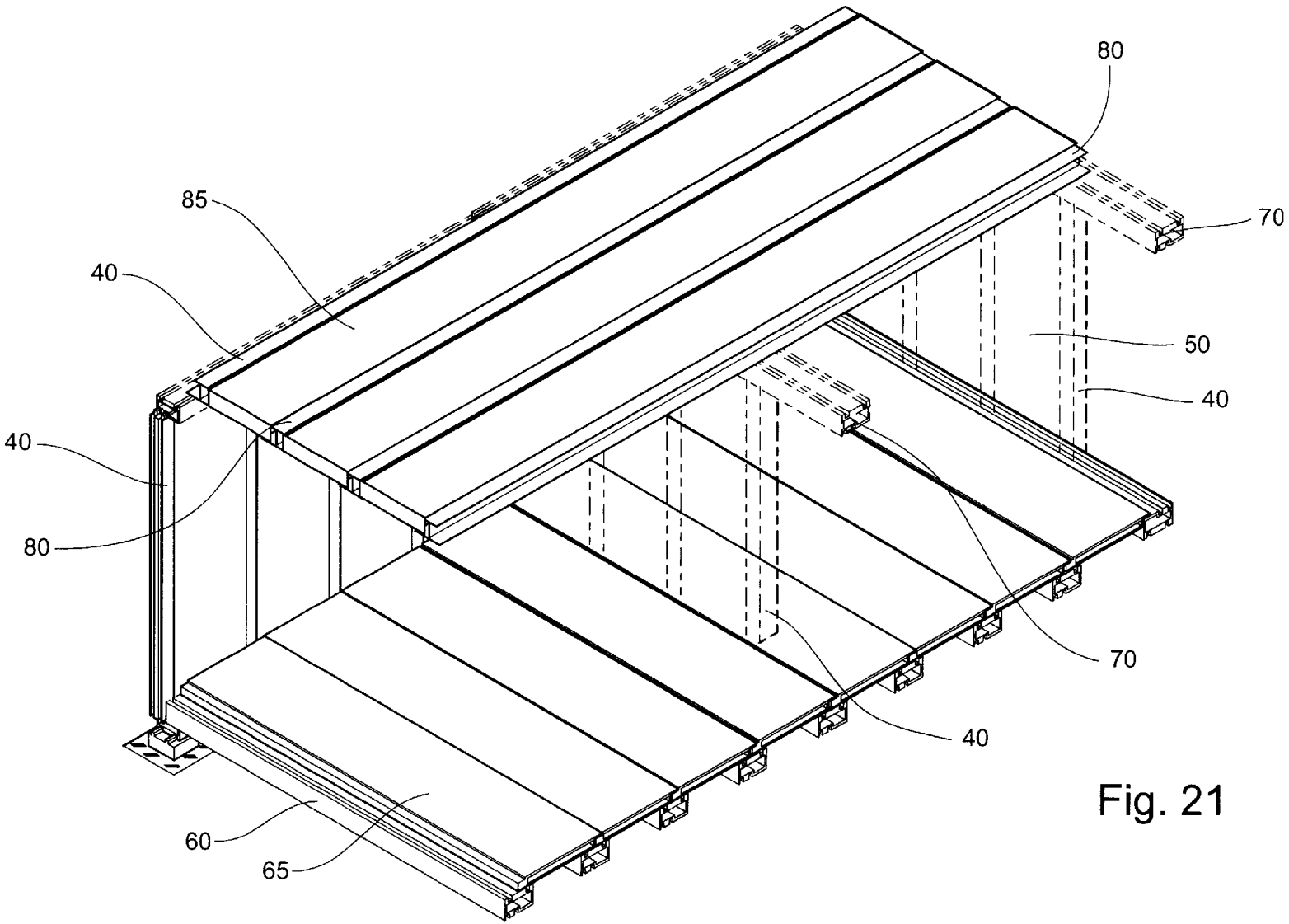
FIG. 21 illustrates the ceiling rafters and panels in place.

Next, the ceiling for the structure is installed, illustrated in FIGS. 20 and 21. This is accomplished by attaching ceiling rafters 80 on top of the wall top plates 70 between the walls for each room. The ceiling rafters 80 are basically I-shaped joists with a wider lower section than upper section. The ceiling rafters 80 are installed 2 feet on-center starting in the right front corner of each room. The ceiling rafters 80 can come in lengths of up to 24 feet and can be attached to the roof structure with support cables, or by other systems, if necessary to prevent sagging over long spans. Preferably, the ceiling rafters 80 are secured, by glue, to the top plates 70 at all points of contact.

After the ceiling rafters 80 are in place, the ceiling panels 85 are installed in between the ceiling rafters 80 and are glued into place on top of the bottom section of the I-beam and are further glued to adjacent ceiling panels 85 wherever they overlap. The ceiling panels 85 are hollow core and filled with insulation. The ceiling panels 85 have a recess that extends around three sides that are glued to the ceiling rafters 80. The recess is designed such that the projecting portion of the ceiling panels 85 fits between the ceiling rafters 80. The basic house framing, floors, utility connection services and ceilings are now completed. The final attachment of the roof is the next step.

Figure 22:
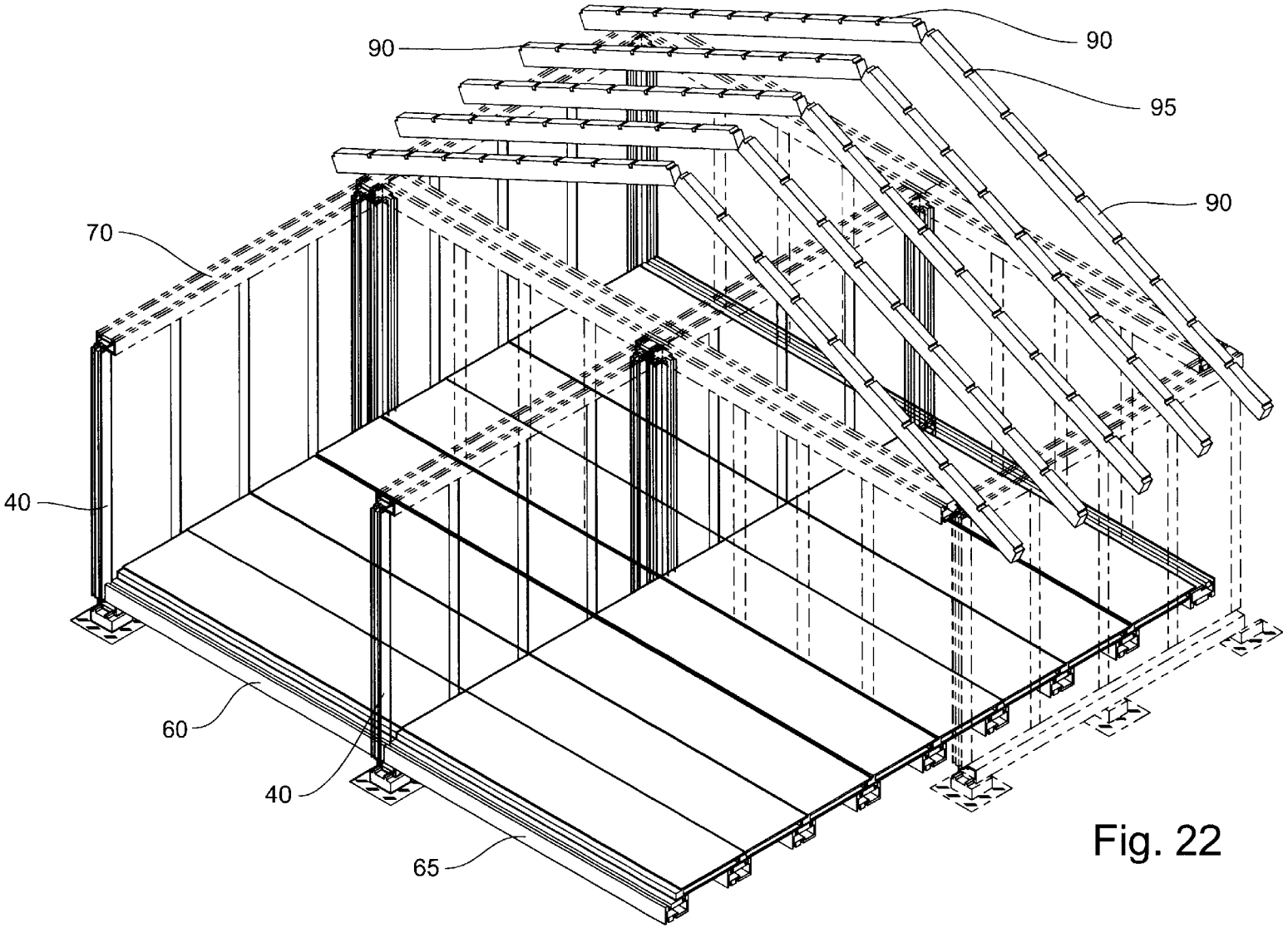
FIG. 22 illustrates the placement of roof rafters for a typical roof structure.
Figure 23:
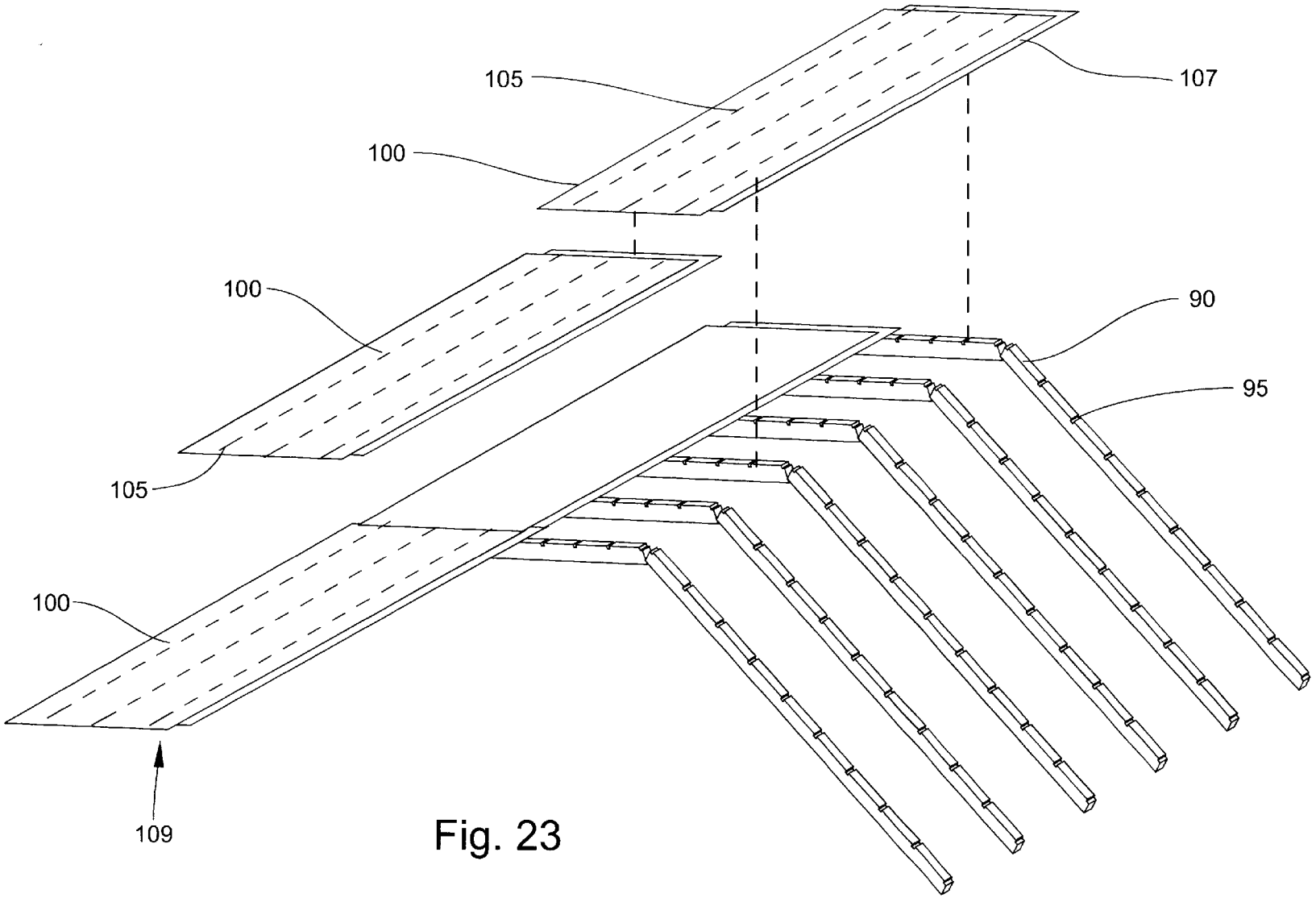
FIG. 23 illustrates how roof panels are attached to the roof rafters.
Figure 24:
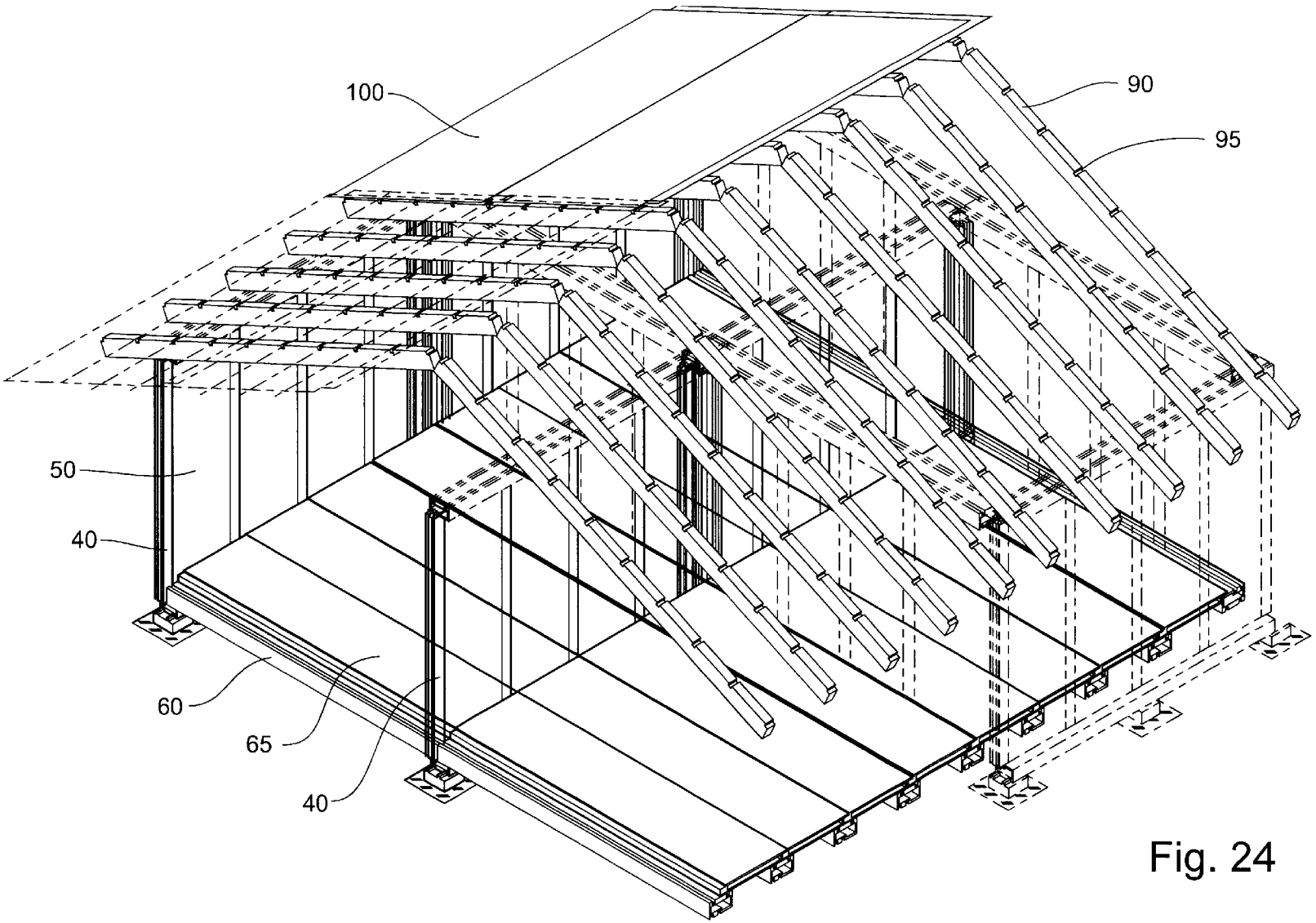
FIG. 24 illustrates a more detailed view of use of the roof rafters and roof panels.
Figure 25:
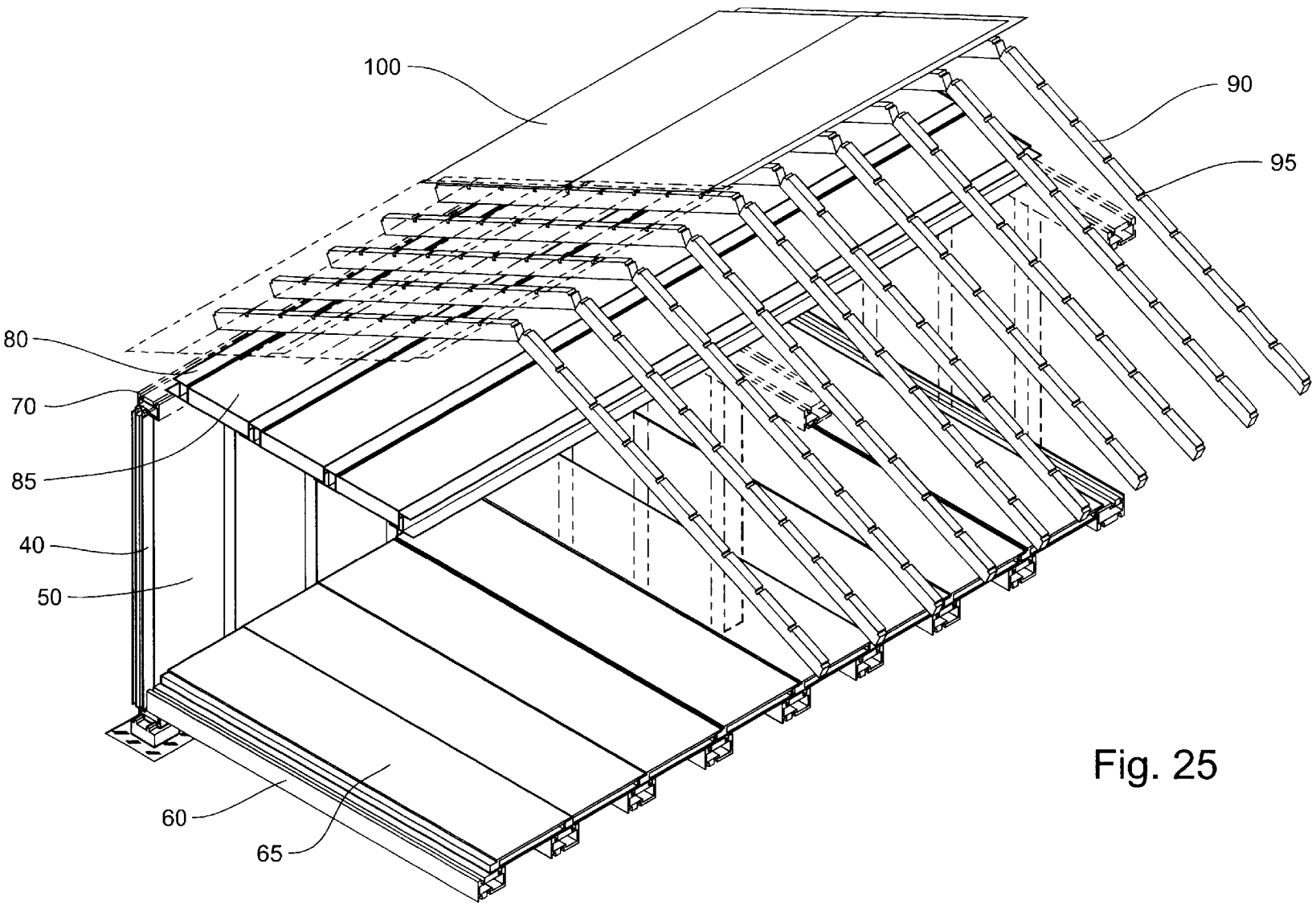
FIG. 25 illustrates a more detailed view including a portion of the ceiling in place.

Since there can be any number of roof designs, the present description will focus on the simple connection of the roof to the main building and the connection of the roof panels to the roof rafters 90. The framing structure chosen to fit the roof design would be built using the grooved wall top plates 70 and 1 inch by ¾ inch insert connectors 120. These would be connected together and attached to the building's frame with the usual gluing process at all points of contact. The roof rafters 90, illustrated in FIG. 22, are preferably 4 inch by 4 inch hollow square tubular structures that have 1 inch by 1 inch grooves 95 located every 12 inches laterally across the rafter to allow for the attachment of the roof panels 100. The roof panels 100 are installed from the outside wall top plate 70 and extend to the center roof rafter 90 of the roof and are mounted on 2 foot centers starting with the right side of the building. They are simply glued to the top plates and center rafter at all points of contact. This is illustrated in FIGS. 23, 24, and 25.

As illustrative examples, for flat roofs, the roof rafters 90 are placed onto the main support beams 25 on the outside walls and securely attached by glue. For pitch roofs, the roof rafters 90 are notched with a saw at the position where the roof rafter makes contact with the main support beams 25 of the outside walls. The main support beams 25 is then fit into the notch and the rafter 90 is then glued into place. For highly pitched roofs, upright posts cut from 4×4 posts are used as well as side glued cross supports to further strengthen the roof rafter system. The cross supports are glued onto the sides of the upright roof raters. This is done so as to be unobtrusive to any outside coverings. The ends of the roof are paneled using regular wall panels and uprights. However, roof panels may be substituted for the wall panels.

The roof panels 100 are overlapping insulated panels that are installed on top of the roof rafters 90 horizontally so that lips 105 on the panels 100 fit into the grooves 95 on the roof rafters. The roof panels 100 have an overhanging lip 107 that extends substantially around two adjacent edges. There is also a recess 109 located on a top surface that also extends substantially around two adjacent edges, but different edges that those of the overhanging lip 107. The roof panels 100 are installed starting at the right bottom of the roof section and are glued to the roof rafters 90 and to each other at all points of contact. The resulting roof construction is a roof that is totally water proof, resistant to thermal changes, and extremely strong.

The final step in constructing the basic house package requires the attachment of a roof apex or general purpose overlap panel 110. The overlap panels 110 are preferably two 4 inch wide connectors that pivot on a hinge joint such that any angle may be achieved through the flexible hinge. The overlap panels 110 are glued onto one roof rafter 90 and then bent and glued to a second roof rafter 90. The overlap panels 110 cover any seams that may result where two or more roof lines intersect. The overlap panel can also be used to cover outside corners of the structure, door seams, or any other seam that is a result of two or more sections joining together. The overlap panel is secured and sealed, such as by an adhesive, over the seam to secure the junction and to eliminate any possible leaks by air or water.

The present invention is a framing design and only allows for the spaces where traditional doors and windows may be attached. Vertical supports 40 and wall top plates 70 are used to frame openings that are then further framed with wood to the appropriate size for whatever is applied, such as a door or window, by the construction personnel. Any "tracked edges" that are exposed inside the door or window frame are filled in using cover pieces. For example, when framing a window opening, a vertical support 40 is cut to allow for a window box frame opening. When framing a door opening, 1 or 2 upright supports may be cut short from the top and the door opening boxed with a wall top plate 70 to form out the door opening frame.

The basic structure is now completed and is totally inter-connected and secured to the ground. Due to the flexibility of the materials used, and the fact that the preferred adhesive effectively chemically welds the components together into one uniformly strong unit, any outside force, such as wind, water, or even ground movement, will be resisted as if it were affecting a natural single piece structure.

As used in this application, the preferred embodiment of all ribs and channels has length and width measurements that are generally 1 inch by 1 inch. All horizontal beams and rafters will come from the factory marked every 2 feet to facilitate locating proper attachment of vertical supports or panels.

Internal walls are provided by attaching interior wall supports 120 to the structure. The interior wall supports 120 are illustrated in FIG. 24 and are generally rectangular in cross section with two grooves 125, one located each on opposite sides of the interior wall supports 120. The two grooves 125 receive interior wall panels 55, similar to the exterior walls.

Figure 27:
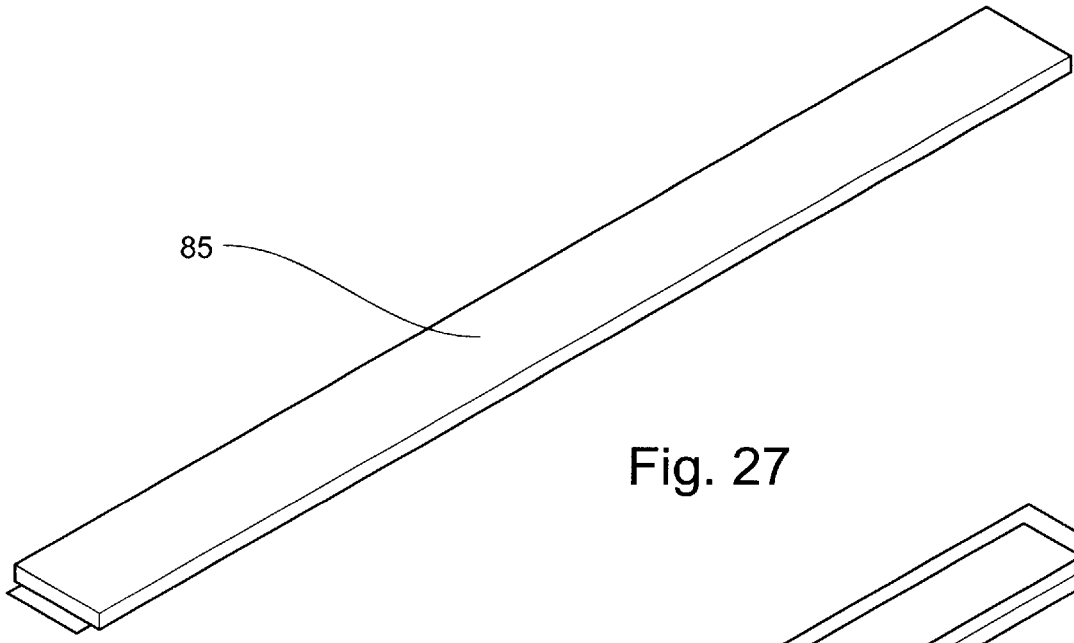
FIG. 27 is a top perspective view of a ceiling panel.
Figure 28:
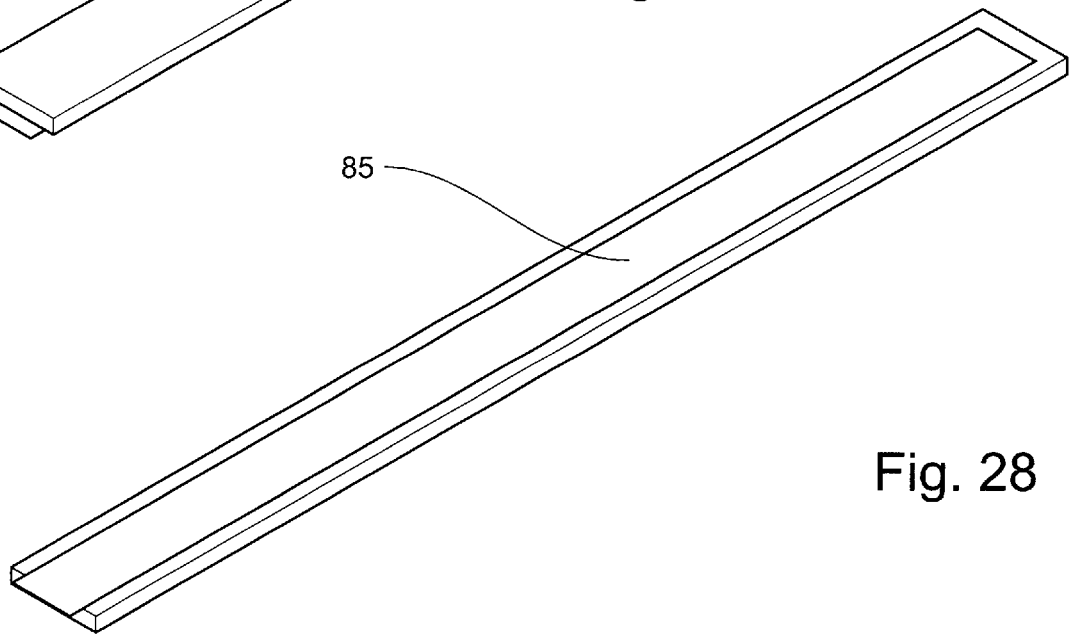
FIG. 28 is a bottom perspective view of a ceiling panel.
Figure 29:
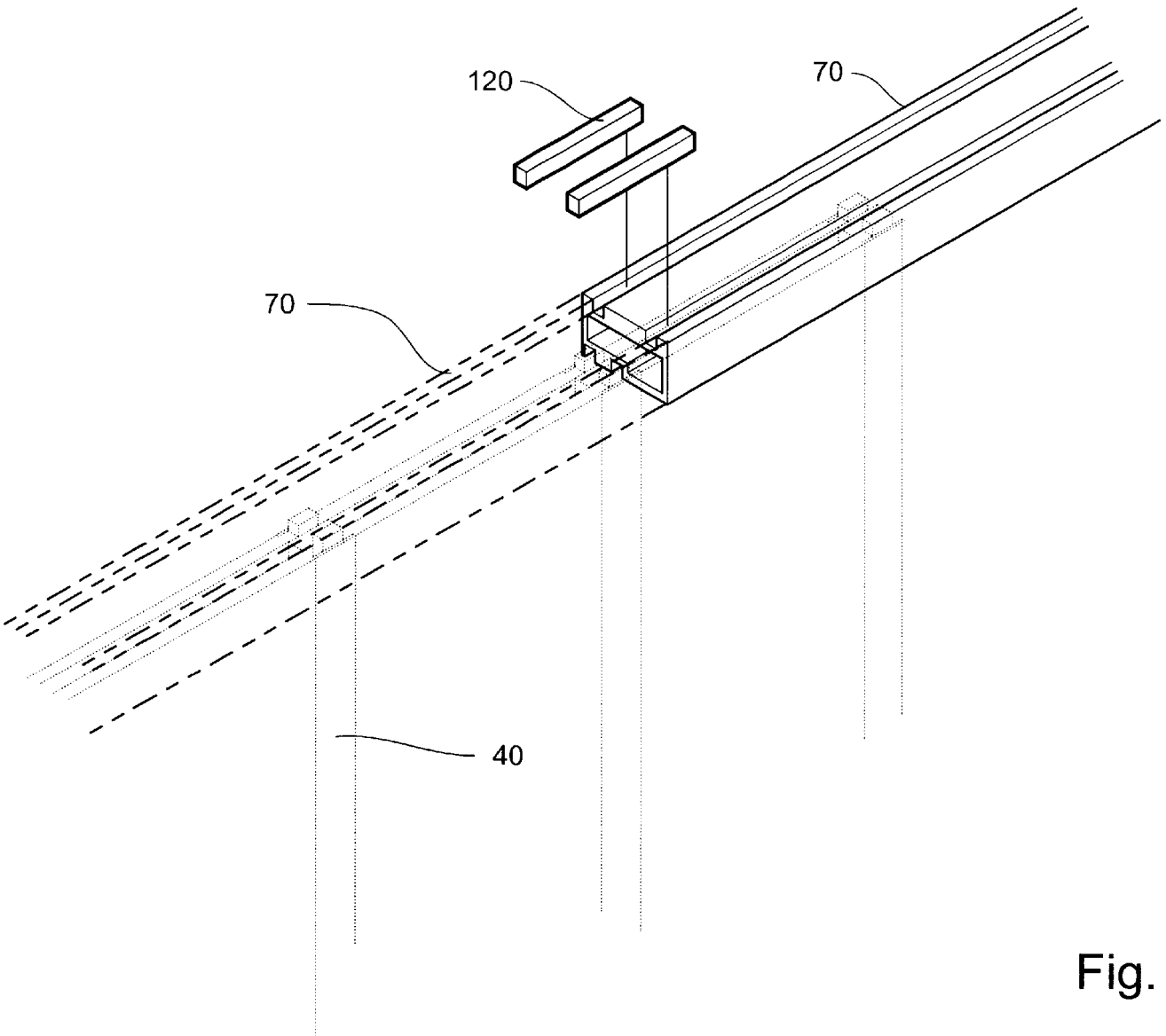
FIG. 29 illustrates how the connectors are used to splice two supports together end-to-end.
Figure 30A:
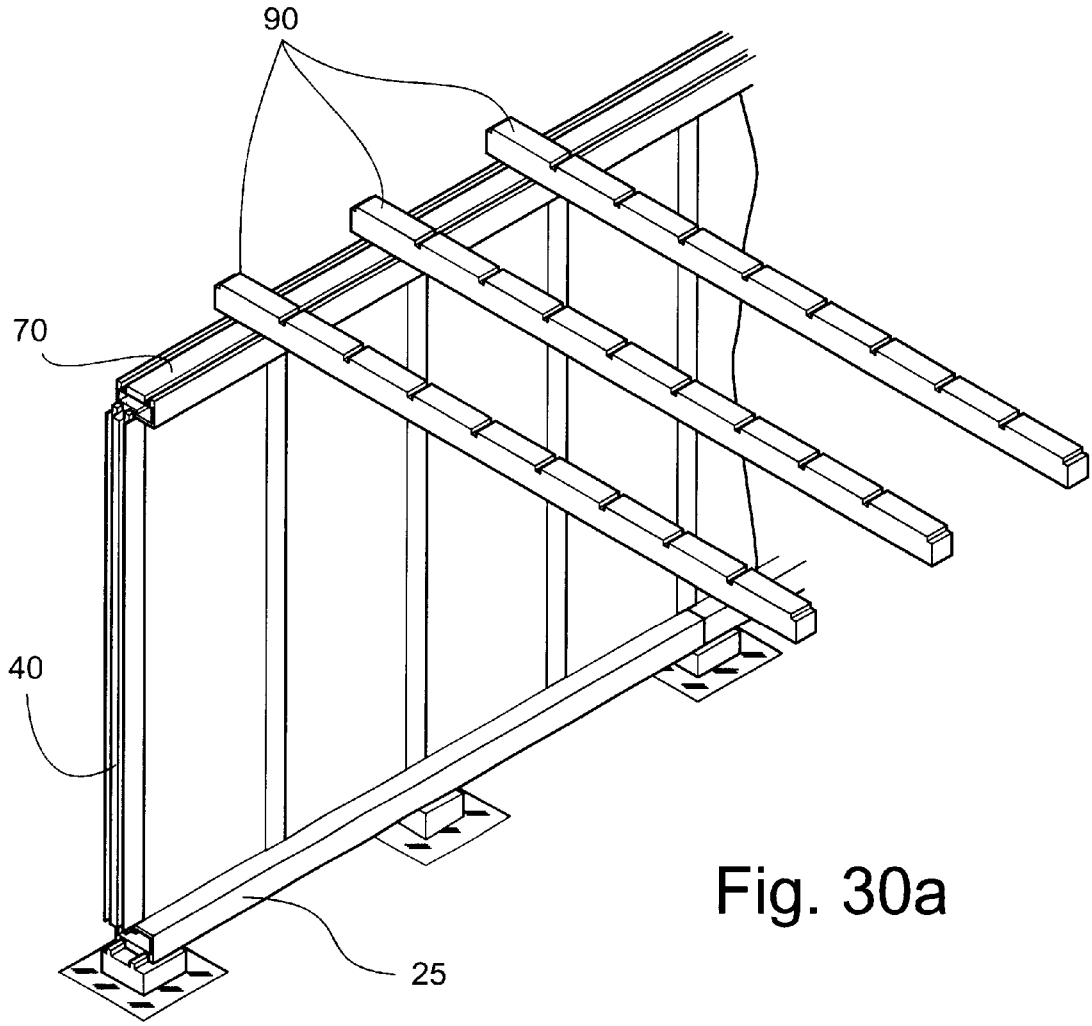
FIG. 30*a* is flat roof framing embodiment.
Figure 32:
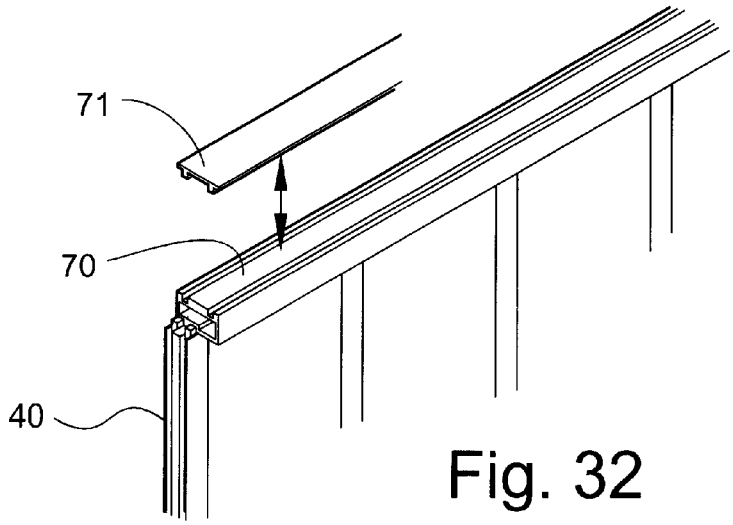
FIG. 32 is a groove cover according to the present invention.
Figure 30B:
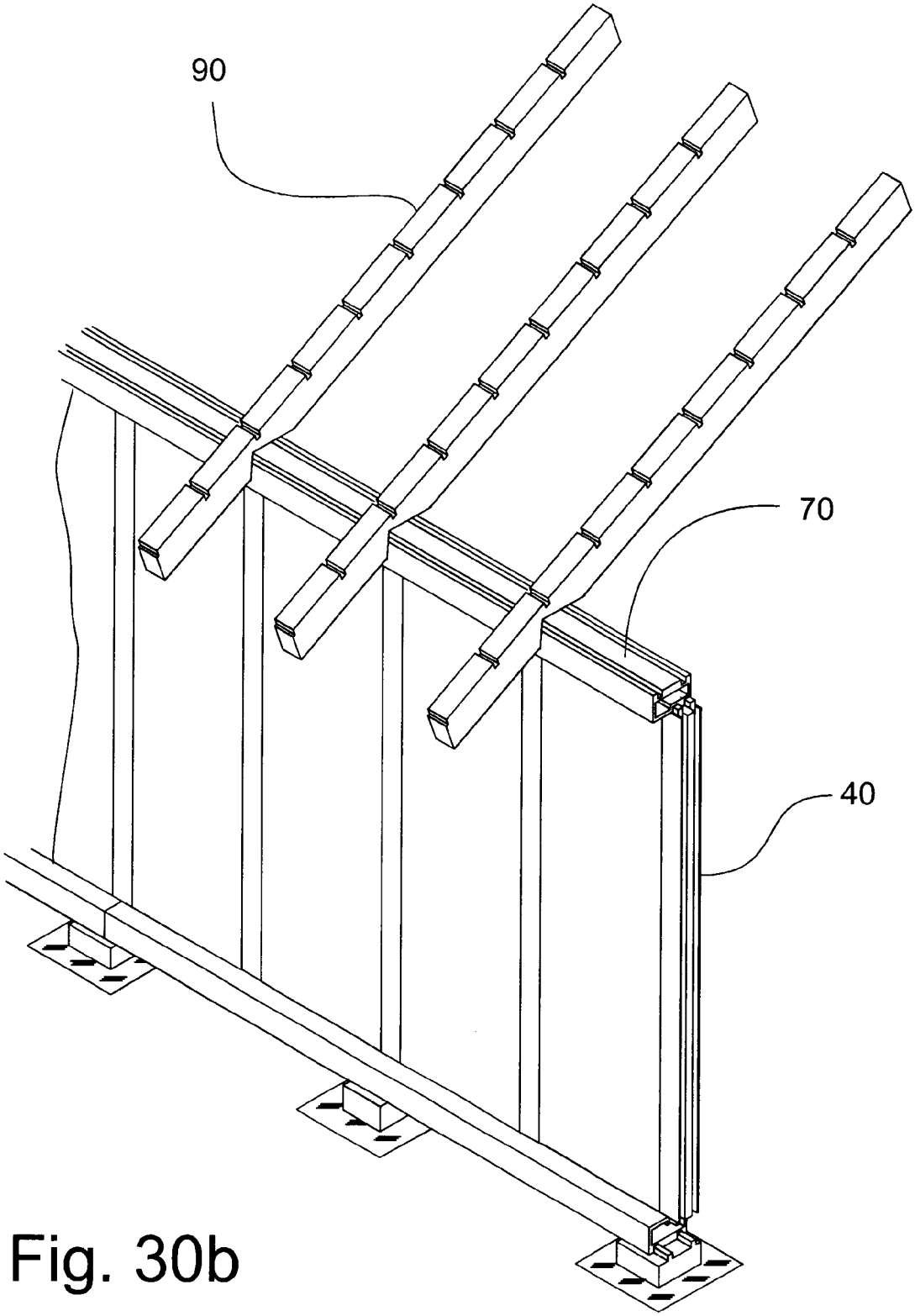
FIG. 30*b* is a peaked roof framing embodiment.
Figure 30C:
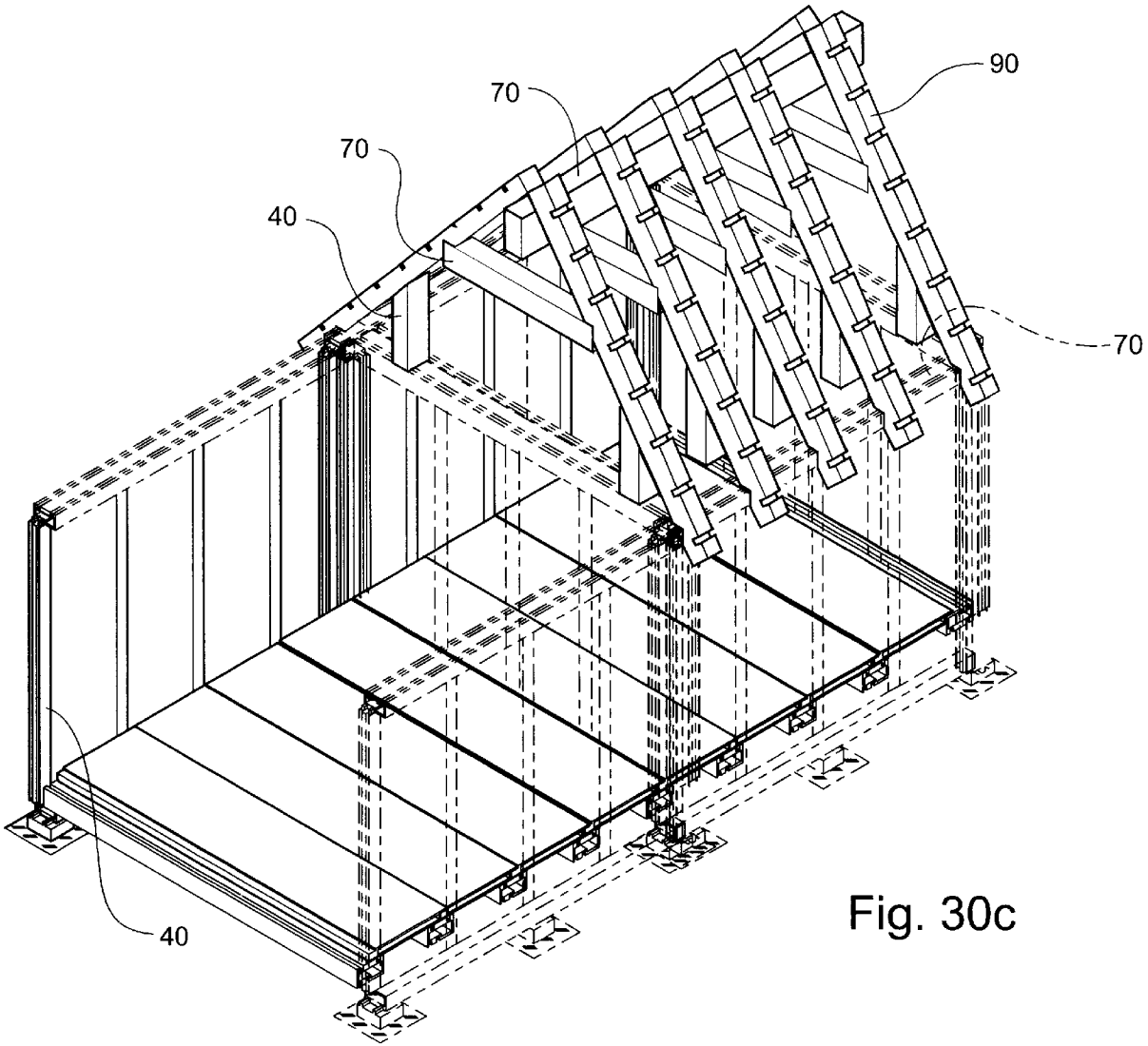
FIG. 30*c* is a high peaked roof framing embodiment.
Figure 31A:
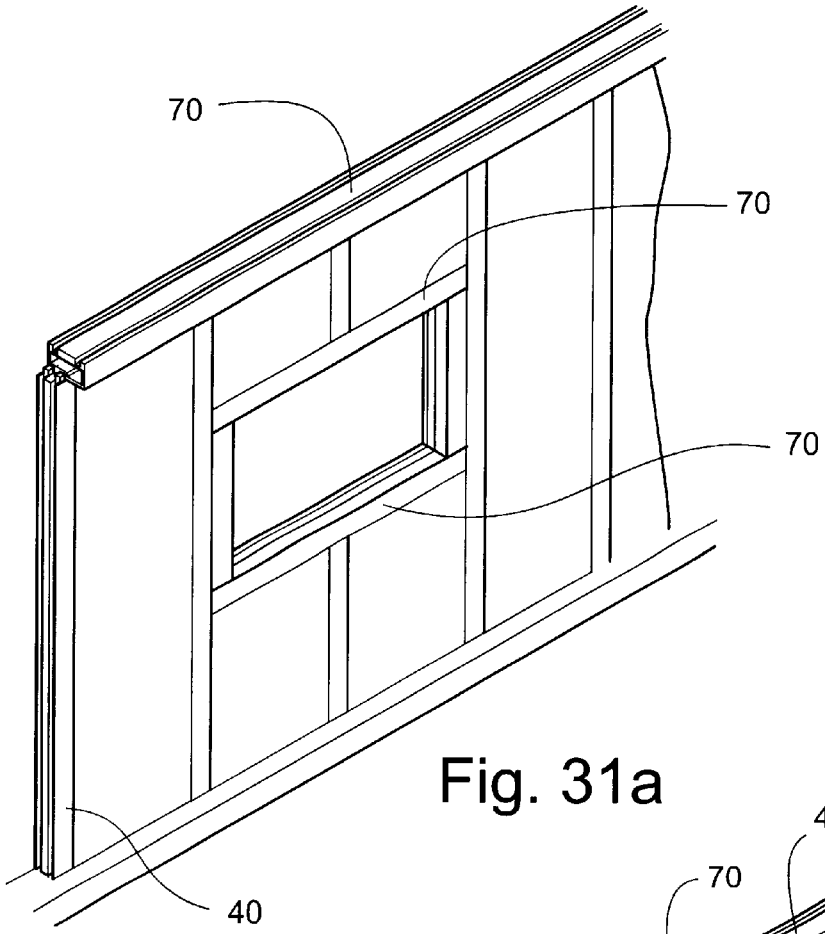
FIG. 31*a* illustrates the framing of a window opening.
Figure 31B:
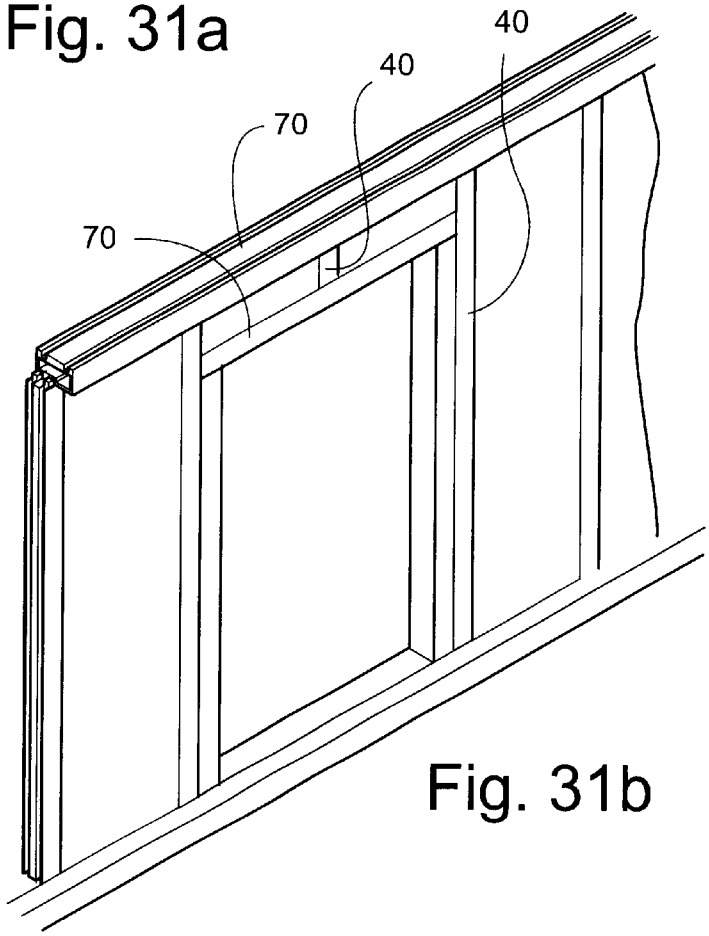
FIG. 31*b* illustrates the framing of a door opening.

Finally, where necessary, there are 1 inch by 2 inch connectors 130 that are substantially flat pieces that are adapted to fit within and between adjacent grooves and that may be used to connect 4×4 structures to created 4×8 or 8×8 composite structures, or interconnect other grooved structures. See FIG. 25. There are flat end caps 140 that are substantially flat surfaces with four projecting ribs 145 that complementarily fit with the end portions of the grooves of a support structure, such as the vertical supports 40 and provide a flat end surface. See FIG. 26. Also, there are floor internal base and top panel holders 150. See FIG. 27. These are used on the top of floors panels 65 or the bottom the ceiling panels 85 for small partitions, such as closets and the like.

The color code system is generally as follows: interior and exterior wall panels 50 and 55 will have the same color. However, the side that is to face outwards will be the side that is colored; the vertical supports 40 and 45 will have one color and the horizontal beams or supports 25 will have another color, even if they are manufactured from the same building materials; roof panels 100 will always have a reflective color and the reflective color will be on the upside.

The preferred embodiment of the invention is described above in the Drawings and Description of Preferred Embodiments. While these descriptions directly describe the above embodiments, it is understood that those skilled in the art may conceive modifications and/or variations to the specific embodiments shown and described herein. Any such modifications or variations that fall within the purview of this description are intended to be included therein as well. Unless specifically noted, it is the intention of the inventors that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A kit for manufacturing a building comprising the following components:

a. a plurality of pillar supports;

b. a plurality of pillar support tops;

c. a plurality of main support beams;

d. a plurality of vertical supports;

e. a plurality of special vertical supports;

f. a plurality of interior wall supports;

g. a plurality of exterior wall panels;

h. a plurality of interior wall panels;

i. a plurality of corner posts;

j. a plurality of floorjoists;

k. a plurality of floor panels;

l. a plurality of wall top plates;

m. a plurality of ceiling rafters;

n. a plurality of ceiling panels;

o. a plurality of roof rafters;

p. a plurality of roof panels;

q. a plurality of insert connectors;

r. a plurality of overlap panels; and s. a plurality of flat end caps;

wherein the special vertical supports further comprise pieces with substantially rectangular cross section, said special vertical supports further having two sets of grooves, on opposite sides of the vertical supports, that extend from one end to the opposite end and two sets of ribs, one set located on each opposed end of the vertical supports, and further having a structure for plumbing connections located on the interior of the special vertical supports, said structure for plumbing connections including a plumbing conduit installed in the interior of the special vertical supports with a universal connector on top and a plumbing outlet junction box that is located at a mid-section of the special vertical support that opens to the interior of the building or a structure for electrical connections located on the interior of the special vertical supports, said structure for electrical connections including an electrical conduit installed in the interior of the special vertical supports with a universal connector on top and an electrical outlet junction box that is located at a mid-section of the special vertical supports that opens to the interior of the building and whereby the components of the system are adapted to be cut and glued together to form a building structure.

2. The kit for manufacturing a building according to claim 1 wherein the pillar supports further comprise a hollow tubular structure with two open ends.

3. The kit for manufacturing a building according to claim 1 wherein the pillar support tops further comprise caps that are adapted to receive the pillar supports, said caps having vertical ribs that extend between two opposite sides of the pillar support tops.

4. The kit for manufacturing a building according to claim 1 wherein the main support beams further comprise pieces that have substantially rectangular cross section, said pieces have two bottom grooves that extend longitudinally from one end to the opposite end on a bottom surface and two top grooves that extend from one end to the opposite end on a top surface, said two bottom grooves further adapted to receive the two ribs on the pillar support tops.

5. The kit for manufacturing a building according to claim 1 wherein the vertical supports further comprise pieces with substantially rectangular cross section, said vertical supports further having two sets of grooves, on opposite sides of the vertical supports, that extend from one end to the opposite end and two sets of ribs, one set located on each opposed end of the vertical supports.

6. The kit for manufacturing a building according to claim 1 wherein the interior wall supports further comprise pieces that are generally rectangular in cross section with two grooves, one located each on opposite sides of the interior wall supports.

7. The kit for manufacturing a building according to claim 1 wherein the exterior wall panels further comprise panels having a male lip located on edges of the panels that are adapted to be received by the grooves located on the sides of vertical support or the special vertical supports.

8. The kit for manufacturing a building according to claim 1 wherein the interior wall panels further comprise panels having a male lip located on edges of the panels that are adapted to be received by the grooves located on the sides of vertical support or the special vertical supports.

9. The kit for manufacturing a building according to claim 1 wherein the corner posts further comprise pieces with a substantially rectangular cross section, said corner posts further having two sets of grooves and ribs, similar to the vertical supports, with the grooves on adjacent sides instead of opposite sides.

10. The kit for manufacturing a building according to claim 1 wherein the floor joists further comprise pieces that have substantially rectangular cross section, said floor joists have two bottom grooves that extend longitudinally from one end to the opposite end on a bottom surface and two top grooves that extend from one end to the opposite end on a top surface, said two bottom grooves further adapted to receive the two ribs on the pillar support tops.

11. The kit for manufacturing a building according to claim 1 wherein the floor panels further comprise panels having a first lip near a top surface long one edge and a second lip near a bottom surface along an opposite edge such that the two lips are adapted to overlap when placed upon the floor joists.

12. The kit for manufacturing a building according to claim 1 wherein the wall top plates further comprise pieces that have substantially rectangular cross section, said wall top plates have two bottom grooves that extend longitudinally from one end to the opposite end on a bottom surface and two top grooves that extend from one end to the opposite end on a top surface, said two bottom grooves further adapted to receive the two ribs on the vertical support or special vertical supports.

13. The kit for manufacturing a building according to claim 1 wherein the ceiling rafters further comprise basically I-shaped joists with a wider lower section than upper section.

14. The kit for manufacturing a building according to claim 1 wherein the ceiling panels further comprise panels having a recess that extends around three sides that are adapted to be attached to the ceiling rafters, said recess is adapted such that the projecting portion of the ceiling panels would fit between the ceiling rafters.

15. The kit for manufacturing a building according to claim 1 wherein the roof rafters further comprise hollow square tubular structures that have grooves located laterally across the rafter to allow for the attachment of the roof panels.

16. The kit for manufacturing a building according to claim 1 wherein the roof panels further comprise overlapping insulated panels that are adapted to be installed on top of the roof rafters horizontally so that lips on the panels would fit into the grooves on the roof rafters, said roof panels also have an overhanging lip that extends substantially around two adjacent edges, further, there is a recess located on a top surface that also extends substantially around two adjacent edges, but different edges that those of the overhanging lip.

17. The kit for manufacturing a building according to claim 1 wherein the insert connectors further comprise substantially flat pieces that are adapted to fit within and between adjacent grooves located in the wall top plates.

18. The kit for manufacturing a building according to claim 1 wherein the overlap panels further comprise two connectors that pivot on a hinge joint such that any angle may be achieved through the flexible hinge joint.

19. A kit for manufacturing a building comprising the following components:

a. a plurality of pillar supports;

b. a plurality of pillar support tops;

c. a plurality of main support beams;

d. a plurality of vertical supports;

e. a plurality of special vertical supports;

f. a plurality of interior wall panels;

g. a plurality of exterior wall panels;

h. a plurality of interior wall panels;

i. a plurality of corner posts;

j. a plurality of floor joists;

k. a plurality of floor panels;

l. a plurality of wall top plates;

m. a plurality of ceiling rafters;

n. a plurality of ceiling panels;

o. a plurality of roof rafters;

p. a plurality of roof panels;

q. a plurality of insert connectors;

r. a plurality of overlap panels; and s. a plurality of flat end caps;

wherein t. the pillar supports further comprise a hollow tubular structure with two open ends;

u. the pillar support tops further comprise caps that are adapted to receive the pillar supports, said caps having vertical ribs that extend between two opposite sides of the pillar support tops;

v. the main support beams further comprise pieces that have substantially rectangular cross section, said pieces have two bottom grooves that extend longitudinally from one end to the opposite end on a top surface, said two bottom grooves further adapted to receive the two ribs on the pillar support tops;

w. the vertical supports further comprises pieces with substantially rectangular cross section, and vertical supports further having two sets of grooves, on opposite sides of the vertical supports, that extend from one end to the opposite end and two sets of ribs, one set located on each opposed end of the vertical supports;

x. the special vertical supports further comprise pieces with substantially rectangular cross section, said special vertical supports further having two sets of grooves, on opposite sides of the vertical supports, that extend from one end to the opposite end and two sets of ribs, one set located on each opposed end of the vertical supports, and further having a structure for plumbing connections located on the interior of the special vertical supports, said structure for plumbing connections including a plumbing conduit installed in the interior of the special vertical supports with a universal connector on top and a plumbing outlet junction box that is located at a mid-section of the special vertical support that opens to the interior of the building or a structure for electrical connections located on the interior of the special vertical supports, said structure for electrical connections including an electrical conduit installed in the interior of the special vertical supports with a universal connector on top and an electrical outlet junction box that is located at a mid-section of the special vertical supports that opens to the interior of the building;

y. the interior wall supports further comprise pieces that are generally rectangular in cross section with two grooves, one located each on opposite sides of the interior wall supports;

z. the exterior wall panels further comprise panels having a male lip located on edges of the panels that are adapted to be received by the grooves located on the sides of vertical support or the special vertical supports;

aa. the interior wall panels further comprise panels having a male lip located on edges of the panels that are adapted to be received by the grooves located on the sides of vertical support or the special vertical supports;

bb. the corner posts further comprise pieces with a substantially rectangular cross section, said corner posts further having two sets of grooves and ribs, similar to the vertical supports, with the grooves on adjacent sides instead of opposite sides;

cc. the floor joists further comprise pieces that have substantially rectangular cross section, said floor joists have two bottom grooves that extend longitudinally from one end to the opposite end on a bottom surface and two top grooves that extend from one end to the opposite end on a top surface, said two bottom grooves further adapted to receive the two ribs on the pillar support tops;

dd. the floor panels further comprise panels having a first lip near a top surface along one edge and a second lip near a bottom surface along an opposite edge such that the two lips are adapted to overlap when placed upon the floor joists;

ee. the wall top plates further comprise pieces that have substantially rectangular cross section, said wall top plates have two bottom grooves that extend longitudinally from one end to the opposite end on a bottom surface and two top grooves that extend from one end to the opposite end on a top surface, said two bottom grooves further adapted to receive the two ribs on the vertical support or special vertical supports;

ff. the ceiling rafters further comprise basically I-shaped joists with a wider lower section than upper section;

gg. the ceiling panels further comprise panels having a recess that extends around three sides that are adapted to be attached to the ceiling rafters, said recess is adapted such that the projecting portion of the ceiling panels would fit between the ceiling rafters;

hh. the roof rafters further comprise hollow square tubular structures that have grooves located laterally across the rafter to allow for the attachment of the roof panels;

ii. the roof panels further comprise overlapping insulated panels that adapted to be installed on top of the roof rafters horizontally so that lips on the panels would fit into the grooves on the roof rafters, said roof panels also have an overhanging lip that extends substantially around two adjacent edges, further, there is a recess located on a top surface that also extends substantially around two adjacent edges, but different edges that those of the overhanging lip;

jj. the insert connectors further comprise substantially flat pieces that are adapted to fit within and between adjacent grooves;

kk. the overlap panels further comprise two connectors that pivot on a hinge joint such that any angle may be achieved through the flexible hinge joint; and ll. the flat end caps further comprise substantially flat surfaces with four projecting ribs that are adapted to fit with the end portions of the grooves of a support structure, such as the vertical supports and provide a flat end surface and whereby the components of the system are adapted to be cut and glued together to form a building structure.

* * * * *